US008496312B2

(12) United States Patent
Sakurada et al.

(10) Patent No.: US 8,496,312 B2
(45) **Date of Patent: *Jul. 30, 2013**

(54) RECORDING APPARATUS AND CONTROL METHOD THEREFOR

(75) Inventors: Yuichi Sakurada, Tokyo (JP); Nobuyuki Satoh, Kanagawa (JP); Masato Kobayashi, Kanagawa (JP); Arata Suzuki, Kanagawa (JP); Tatsuhiko Okada, Saitama (JP); Daisaku Horikawa, Saitama (JP); Daisuke Sawada, Saitama (JP); Norikazu Taki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 231 days.

This patent is subject to a terminal disclaimer.

(21) Appl. No.: 13/064,213

(22) Filed: Mar. 11, 2011

(65) Prior Publication Data

US 2011/0298854 A1 Dec. 8, 2011

(30) Foreign Application Priority Data

Jun. 7, 2010 (JP) ..... 2010-130243

(51) Int. Cl.
*B41J 29/38* (2006.01)

(52) U.S. Cl.
USPC ..... 347/14

(58) Field of Classification Search
USPC ..... 347/14
See application file for complete search history.

(56) References Cited

U.S. PATENT DOCUMENTS

| | | | |
|---|---|---|---|
| 2008/0225067 | A1 | 9/2008 | Morino et al. |
| 2008/0225068 | A1 | 9/2008 | Morino et al. |
| 2009/0316164 | A1 | 12/2009 | Takahashi et al. |
| 2010/0225693 | A1 | 9/2010 | Sakurada et al. |
| 2010/0231632 | A1 | 9/2010 | Kobayashi et al. |
| 2011/0007112 | A1 | 1/2011 | Takei et al. |
| 2011/0056808 | A1 | 3/2011 | Satoh et al. |
| 2011/0063352 | A1 | 3/2011 | Sakurada et al. |

FOREIGN PATENT DOCUMENTS

| | | | |
|---|---|---|---|
| JP | 2008221729 | A | 9/2008 |
| JP | 2008229917 | A | 10/2008 |
| JP | 2008229921 | A | 10/2008 |

OTHER PUBLICATIONS

Abstract of JP 2008-229921 published Oct. 2, 2008.
Abstract of JP 2008-229917 published Oct. 2, 2008.
Abstract of JP 2008-221729 published Sep. 25, 2008.

*Primary Examiner* — Laura Martin
(74) *Attorney, Agent, or Firm* — Harness, Dickey & Pierce P.L.C.

(57) ABSTRACT

A recording apparatus includes a carriage having a recording head including nozzles, a moving unit moving the carriage, a platen including plate members connected in a carriage traveling direction to support a recording medium when the nozzles eject ink onto the recording medium, a transferring unit transferring the recording medium in a transferring direction perpendicular to the carriage traveling direction, a recording control unit recording patterns at predetermined positions in the carriage traveling direction while moving the carriage in forward and backward traveling directions to form a carriage traveling direction pattern array, a determination unit determining ink ejecting times at the predetermined positions in the carriage traveling direction, and a time control unit to linearly interpolate between the determined ink ejecting times at the predetermined positions in the carriage traveling direction to control ink ejecting times for intervals between the predetermined positions based on a result of the linear interpolation.

9 Claims, 33 Drawing Sheets

FIG.15

| ADDRESS INFORMATION | ENCODER VALUE FOR TEST PATTERN | EJECTING TIME ADJUSTING VALUE: dly | SLOPE: δ |
|---|---|---|---|
| 1 | dly pos1 | dly1 | δ 1 |
| 2 | dly pos2 | dly2 | δ 2 |
| 3 | dly pos3 | dly3 | δ 3 |
| * | * | * | * |
| * | * | * | * |
| N−1 | dly posN−1 | dlyN−1 | δ N−1 |
| N | dly posN | dlyN | 0 |
| N' | dly posN | dly'N | δ 'N−1 |
| N'−1 | dly posN−1 | dly'N−1 | δ 'N−2 |
| * | * | * | * |
| 4' | dly pos4 | dly'4 | δ '3 |
| 3' | dly pos3 | dly'3 | δ '2 |
| 2' | dly pos2 | dly'2 | δ '1 |
| 1' | dly pos1 | dly'1 | 0 |

| SYMBOL | DESCRIPTION |
|---|---|
| Vcrg | CARRIAGE SPEED |
| Vjet | INK EJECTING SPEED |
| θ | SLOPE OF PLATEN |
| ϕ | INK EJECTING ANGLE |
| hm | CARRIAGE-PLATEN DISTANCE AT ENCODER VALUE Xm |
| lm | INK EJECTING DISTANCE AT ENCODER VALUE Xm |
| h1 | CARRIAGE-PLATEN DISTANCE AT ENCODER VALUE X1 |
| l1 | INK EJECTING DISTANCE AT ENCODER VALUE X1 |

RECORDING APPARATUS AND CONTROL METHOD THEREFOR

BACKGROUND OF THE INVENTION

1. Field of the Invention

The invention generally relates to a recording apparatus such as an inkjet printer and a method for controlling the recording apparatus.

2. Description of the Related Art

In a typical inkjet recording apparatus, a recording head attached to a carriage ejects ink onto a recording medium placed on a platen to form an image (dots) on the recording medium while reciprocating the carriage in a main-scanning direction (i.e., a carriage traveling direction). The dots are repeatedly recorded on the recording medium while the recording medium is transferred in a sub-scanning direction (i.e., in a direction perpendicular to the carriage traveling direction) using a transfer roller, to thereby form a complete image on the recording medium. Note that the platen is a supporting member to support the recording medium while the ink is ejected onto the recording medium.

In the inkjet recording apparatus, a relative distance between the platen and the carriage may vary with a position of the carriage in the main-scanning direction due to an assembling error of the carriage, deterioration in sliding bearings of the carriage with aging, and the like.

When the relative distance between the platen and the carriage has varied with the position of the carriage in the main-scanning direction, the ink is attached to positions differing from desired ones (ideal positions) on the recording medium. Thus, it may be difficult to form the image with high resolution and stability.

Note that the above inconsistent distance between the platen and the carriage may also occur when the platen is shifted in the main-scanning direction. Similar to the carriage case, the platen may be shifted in the main-scanning direction due to an assembling error of the platen, aging of the platen, and the like. Further, if the platen is composed of plural plate members, the plate members maybe shifted with different angles relative to the main-scanning direction.

If the platen is shifted in the main-scanning direction, or the plate members of the platen are shifted with different angles relative to the main-scanning direction, the relative distance between the platen and the carriage may vary with the position of the carriage in the main-scanning direction.

As a result, even if the image is formed by reciprocating the carriage that is not tilted in the main-scanning direction, the ink may be attached to positions differing from desired ones (ideal positions) on the recording medium, which makes it difficult to form the image with high resolution and stability. That is, when the relative distance between the platen and the carriage varies with the position of the carriage in the main-scanning direction, the positions of ink droplets are shifted from the desired ones (ideal positions) on the recording medium. Thus, it may be difficult to form the image with high resolution and stability.

Japanese Patent Application Publication No. 2008-221729 (hereinafter called "Patent Document 1"), for example, discloses a technology for enabling registration adjustment corresponding to an unevenly curved recording medium in a main-scanning direction of a recording head while forming an image on the recording medium.

With this technology, a user configures a recording apparatus such that test patterns are recorded at two or more positions including projected portions and recessed portions of the unevenly curved recording medium while reciprocating the recording head in the scanning direction. The test patterns are recorded at the two or more positions set by the user on the recording medium in forward and backward traveling directions by making the recording time in the backward traveling direction different from the recording time in the forward traveling direction. The registration adjustment for recording an image on the unevenly curved recording medium in the backward traveling direction is made based on the recording time at which an optimal test pattern is recorded. Accordingly, the registration adjustment is appropriately made when the unevenly curved recording medium is used, and ink droplet misalignments on the recording medium obtained while recording in the reciprocating directions may be reduced.

In the technology disclosed in Patent Document 1, however, the user needs to set the positions on the recording medium at which the test patterns are to be recorded, which may create extra work for the user.

Moreover, the platen used in the technology disclosed in Patent Document 1 is made as a single unit, and hence, the platen formed of plural plate members connected in the scanning direction (carriage traveling direction) may be beyond the scope of the assumption. The ink droplet misalignments or the like due to the configuration of the platen formed of the connected plate members may not be controlled by the technology disclosed in Patent Document 1.

SUMMARY OF THE INVENTION

It is a general object of at least one embodiment of the present invention to provide a recording apparatus and a method for controlling the recording apparatus that substantially eliminate one or more problems caused by the limitations and disadvantages of the related art. Specifically, the embodiments of the present invention attempt to provide a recording apparatus including a platen composed of plural plate members connected in a main-scanning direction (carriage traveling direction) and a method for controlling the recording apparatus capable of controlling ink droplet misalignments caused by changes in relative distances between the plural plate members of the platen and the carriage in the main-scanning direction.

In one embodiment, there is provided a recording apparatus that includes a carriage having a recording head including plural nozzles for ejecting ink; a moving unit configured to move the carriage having the recording head including the plural nozzles for ejecting ink; a platen including plate members connected in a carriage traveling direction and configured to support a recording medium when the plural nozzles of the carriage eject ink onto the recording medium; a transferring unit configured to transfer the recording medium in a transferring direction perpendicular to the carriage traveling direction; a recording control unit configured to record patterns at predetermined positions, a number of which corresponds to a number of plate members, in the carriage traveling direction on a surface of the recording medium supported by the platen while moving the carriage in forward and backward traveling directions to form a carriage traveling direction pattern array; a determination unit configured to determine the ink ejecting times at the predetermined positions in the carriage traveling direction where the respective patterns are recorded on the surface of the recording medium; and a time control unit configured to linearly interpolate between the determined ink ejecting times at the predetermined positions in the carriage traveling direction on the surface of the recording medium to control ink ejecting times for respective intervals between the predetermined positions in the carriage traveling direction based on the linear interpolation between the determined ink ejecting times at the predetermined positions in the carriage traveling direction.

In another embodiment, there is provided a method for controlling a recording apparatus including a carriage having a recording head including plural nozzles for ejecting ink, a moving unit configured to move the carriage, a platen including plate members connected in a carriage traveling direction and configured to support a recording medium when the plural nozzles of the carriage eject ink onto the recording medium, and a transferring unit configured to transfer the recording medium in a direction perpendicular to the carriage traveling direction. The method includes recording patterns at predetermined positions, a number of which corresponds to a number of plate members, in the carriage traveling direction on a surface of the recording medium supported by the platen while moving the carriage in forward and backward traveling directions to form a carriage traveling direction pattern array; determining ink ejecting times at the predetermined positions in the carriage traveling direction where the respective patterns are recorded on the surface of the recording medium; and linearly interpolating between the determined ink ejecting times at the predetermined positions in the carriage traveling direction on the surface of the recording medium to control ink ejecting times for respective intervals between the predetermined positions in the carriage traveling direction based on the linear interpolation between the determined ink ejecting times at the predetermined positions in the carriage traveling direction.

BRIEF DESCRIPTION OF THE DRAWINGS

Other objects and further features of embodiments will be apparent from the following detailed description when read in conjunction with the accompanying drawings, in which:

FIG. 15 is a configuration diagram illustrating a correspondence table referred to by a calculator circuit 6;

DESCRIPTION OF THE PREFERRED EMBODIMENTS

[Outline of Recording Apparatus]

In the following, embodiments of the present invention will be described with reference to FIGS. 2 through 4 and FIGS. 7 through 10.

Figure 9:
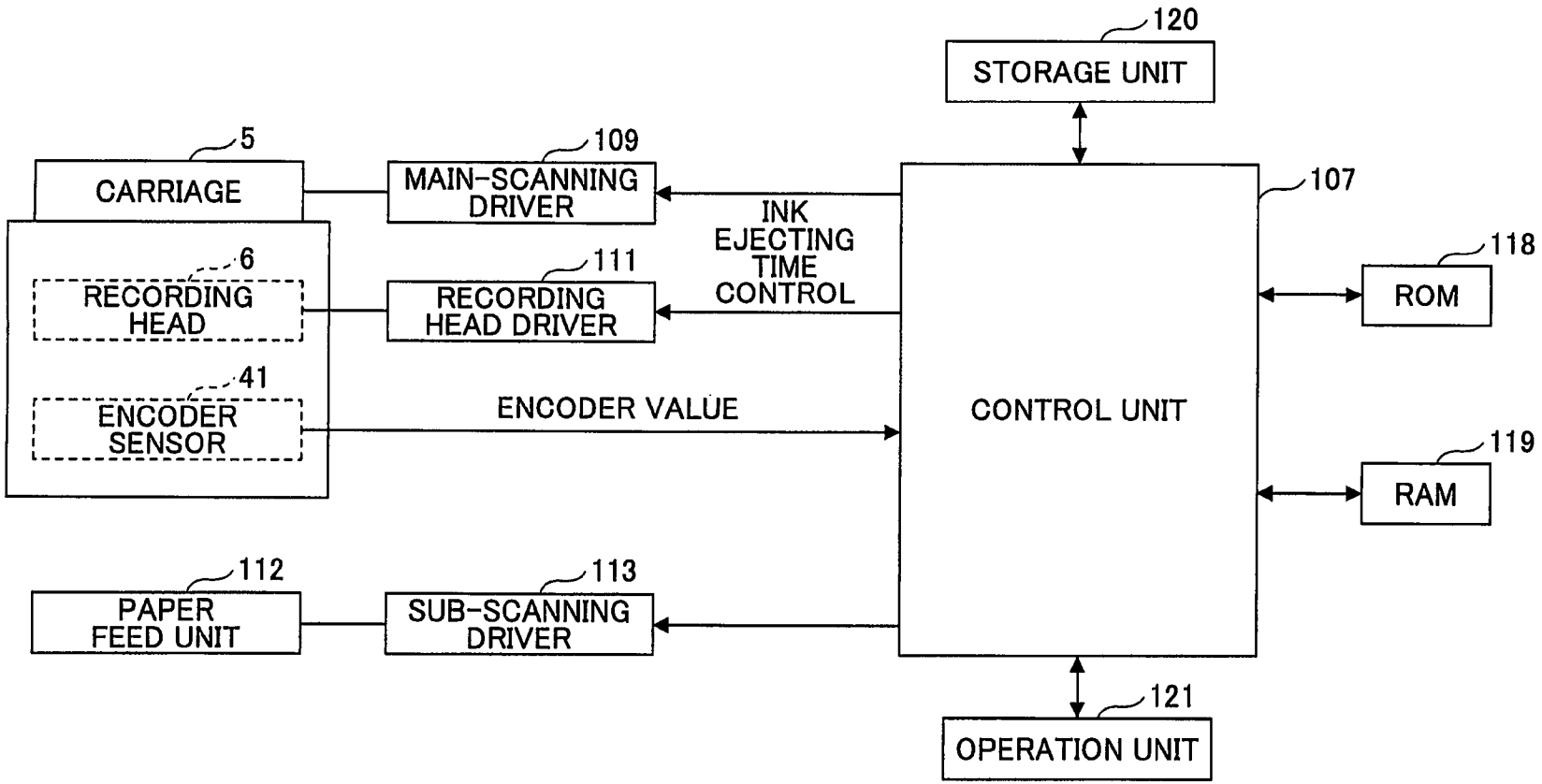
FIG. 9 is a configuration diagram illustrating a control mechanism of the recording apparatus according to the first embodiment.

As illustrated in FIGS. 2 through 4 and FIG. 9, a recording apparatus according to the embodiments of the invention includes a carriage 5 having a recording head 6 composed of plural nozzles for ejecting ink, a moving unit (i.e., a control unit 107 and a main-scanning driver 109 in FIG. 9) configured to move the carriage 5, a platen 200 configured to support a recording medium 16 onto which ink is ejected from the nozzles, the platen 200 being formed of plural plate members 300 connected in a carriage traveling direction, and a transferring unit (i.e., the control unit 107, a sub-scanning driver 113, and a paper feed unit 112 in FIG. 9) configured to transfer the recording medium 16 in a direction perpendicular to the carriage traveling direction.

Figure 7:
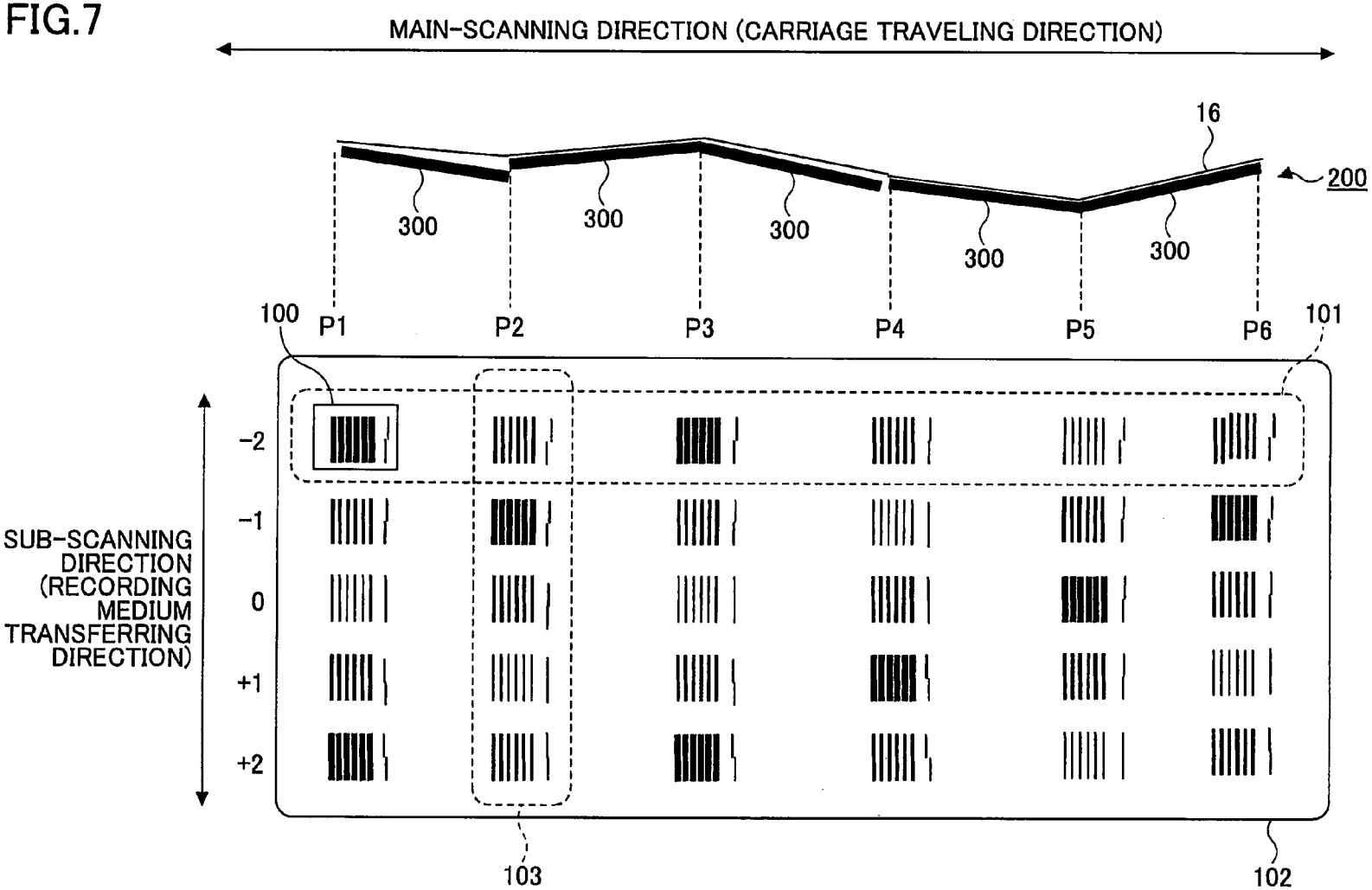
FIG. 7 is a third diagram illustrating an example of the recording method of the test patterns 100.
Figure 10:
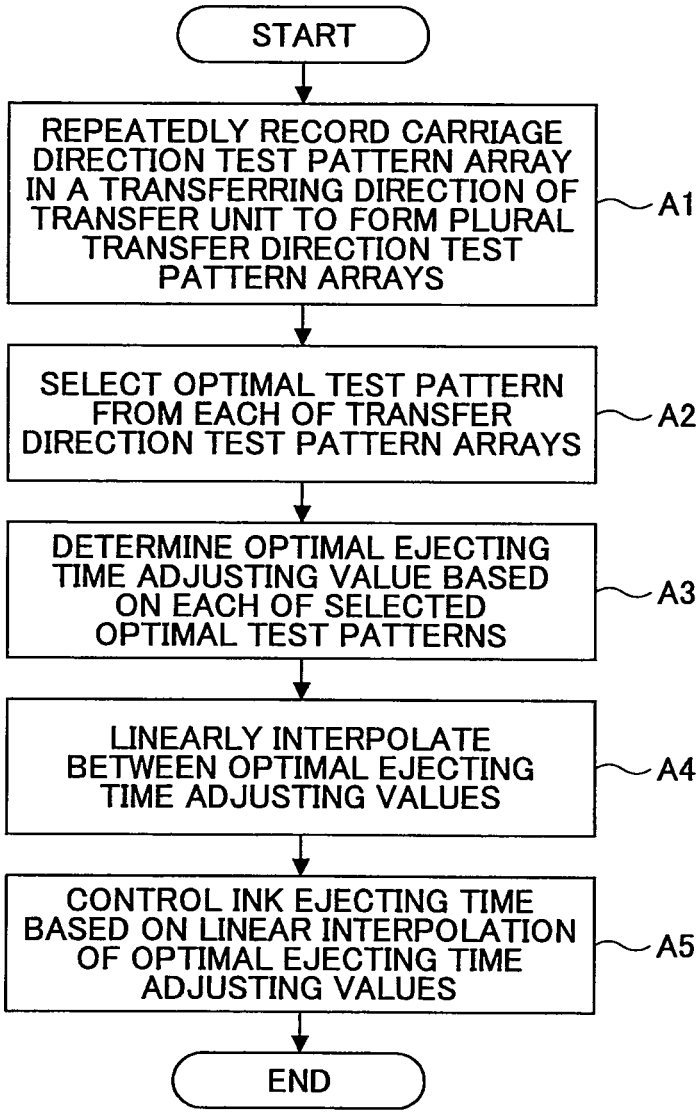
FIG. 10 is a diagram illustrating an example of processing of the recording apparatus according to the first embodiment.

As illustrated in FIG. 7, the recording apparatus according to the embodiments records test patterns 100 at predetermined positions P1 to P6, the number of which corresponds to the number of plate members 300 forming the platen 200, in the carriage traveling direction on the recording medium 16 while reciprocating the carriage 5 in the carriage traveling direction, thereby forming a carriage traveling direction pattern array 101 (step A1 in FIG. 10).

Next, ink ejecting times at the predetermined positions P1 through P6 are determined (steps A2 and A3 in FIG. 10).

Subsequently, ink ejecting times at respective intervals between the predetermined positions P1 through P6 are controlled based on a result obtained by linearly interpolating the determined ejecting times at the predetermined positions P1 through P6 (steps A4 and A5 in FIG. 10).

Accordingly, in the recording apparatus according to the embodiments including the platen 200 composed of the plural plate members 300 connected in the main-scanning direction (carriage traveling direction), it is possible to reduce the ink droplet misalignments occurring due to the changes in relative distances between the plural plate members 300 of the platen 200 and the carriage 5 in the main-scanning direction. A detailed description is given below, with reference to the accompanying drawings.

[First Embodiment]

[Schematic Configuration Example of Mechanical Unit of Recording Apparatus]

Figure 1:
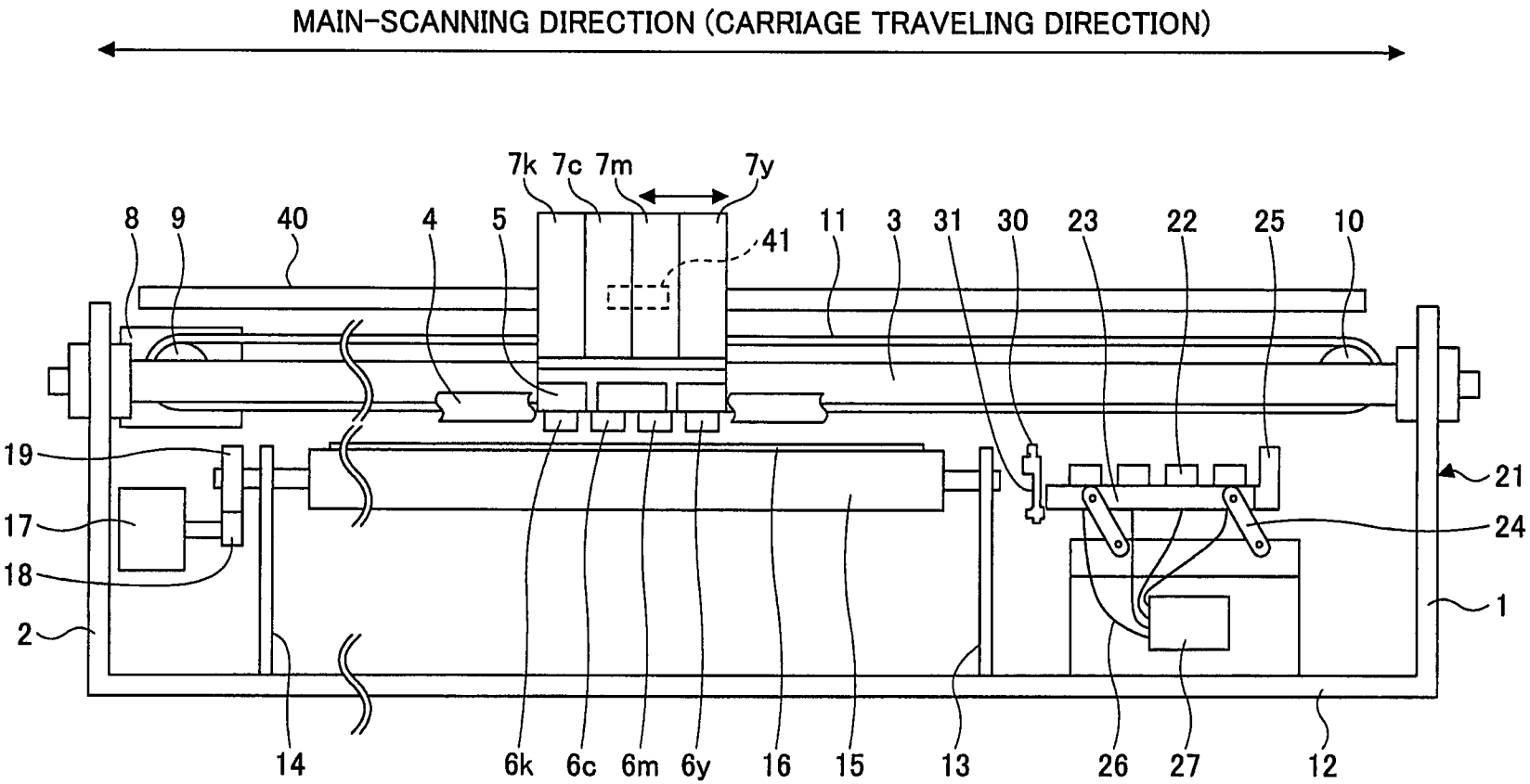
FIG. 1 is a schematic configuration diagram. illustrating a mechanical unit of a recording apparatus according to a first embodiment.

Referring to FIG. 1, a schematic configuration example of a mechanical unit of the recording apparatus according to a first embodiment is described.

The recording apparatus according to the first embodiment includes side plates 1 and 2, a main supporting guide rod 3 and sub-supporting guide rods 4 arranged in an approximately horizontal position between the side plates 1 and 2, and the carriage 5 slidably supported by the main supporting guide rod 3 and the sub-supporting guide rods 4 in a main-scanning direction.

The carriage 5 includes four recording heads 6*y*, 6*m*, 6*c*, and 6*k* having respective downwardly directed ejecting faces (nozzle faces) for ejecting yellow (Y) ink, magenta (M) ink, cyanogen (C) ink, and black (K) ink. The carriage 5 further includes four replaceable ink cartridges 7 (reference numeral "7" indicates one of 7*y*, 7*m*, 7*c*, and 7*k*, or their generic term) above the respective recording heads 6 (hereinafter, reference numeral "6" indicates one of 6*y*, 6*m*, 6*c*, and 6*k*, or their generic term). The ink cartridges 7 are used as ink suppliers to supply ink of respective color to the four recording heads. The carriage 5 is connected to a timing belt 11 looped over a driving pulley (driving timing pulley) 9 rotated by a main-scanning motor 8 and a driven pulley (idler pulley) 10, such that the carriage 5 is driven and controlled in the main-scanning direction by the main-scanning motor 8. The carriage 5 includes an encoder sensor 41 configured to detect a mark on an encoder sheet 40 and to obtain an encoder value based on the detected mark. The carriage 5 travels in the main-scanning direction based on the obtained encoder value.

The recording apparatus according to the first embodiment further includes a bottom plate 12 connecting the side plates 1 and 2, sub-frames 13 and 14 on the bottom plate 12, and a transferring roller 15 rotationally supported between the sub-frames 13 and 14. The recording apparatus according to the first embodiment further includes a sub-scanning motor 17 on the sub-frame 14 side, and a first gear 18 fixed on a rotational shaft of the sub-scanning motor 17 and a second gear 19 fixed on a shaft of the transferring roller 15, thereby transmitting torque of the sub-scanning motor 17 to the transferring roller 15.

The recording apparatus according to the first embodiment further includes a reliability maintenance recovery mechanism (hereinafter referred to as a "sub-system") 21 for the recording heads 6 located between the side plate 1 and the sub-frame 13. The sub-system 21 includes four caps 22 to cap the ejecting faces of the recording heads 6, a holder 23 to support the caps 22, and link members 24 to reciprocally support the holder 23. If the carriage 5 is moved in the main-scanning direction to abut an engaging portion 25 on the holder 23, the holder 23 is raised so that the caps 22 cap the respective ejecting faces of the recording heads 6. Further, if the carriage 5 is moved to an image forming region (i.e., in the recording medium 16), the holder 23 is lowered such that the caps 22 are retracted from the ejecting faces of the recording heads 6.

Note that the caps 22 are connected to a suction pump 27 via respective suction tubes 26, and the caps 22 also include respective air release holes configured to communicate with ambient atmosphere air via air release tubes and an air release valve. The suction pump 27 discharges suctioned waste liquid (ink) in a waste liquid depot.

Note also that a wiper blade 30 for wiping the ejecting faces of the recording heads 6 is attached to a blade arm 31 provided on a side of the holder 23. The blade. arm 31 is movably supported by the holder 23 such that the blade arm 31 is moved by rotations of a cam driven by a not-shown driving unit.

[Configuration Example of Recording Mechanism of Recording Apparatus]

Figure 2:
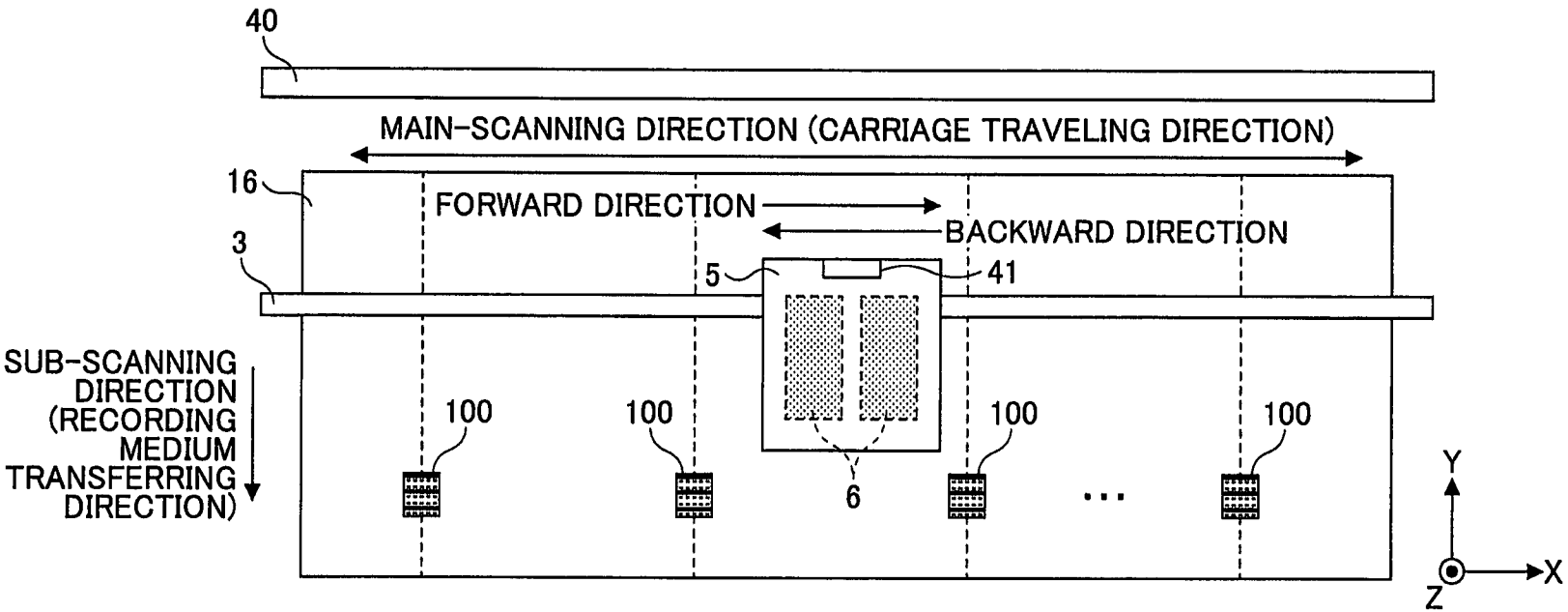
FIG. 2 is a first schematic configuration diagram illustrating a recording mechanism of the recording apparatus according to the first embodiment.
Figure 3:
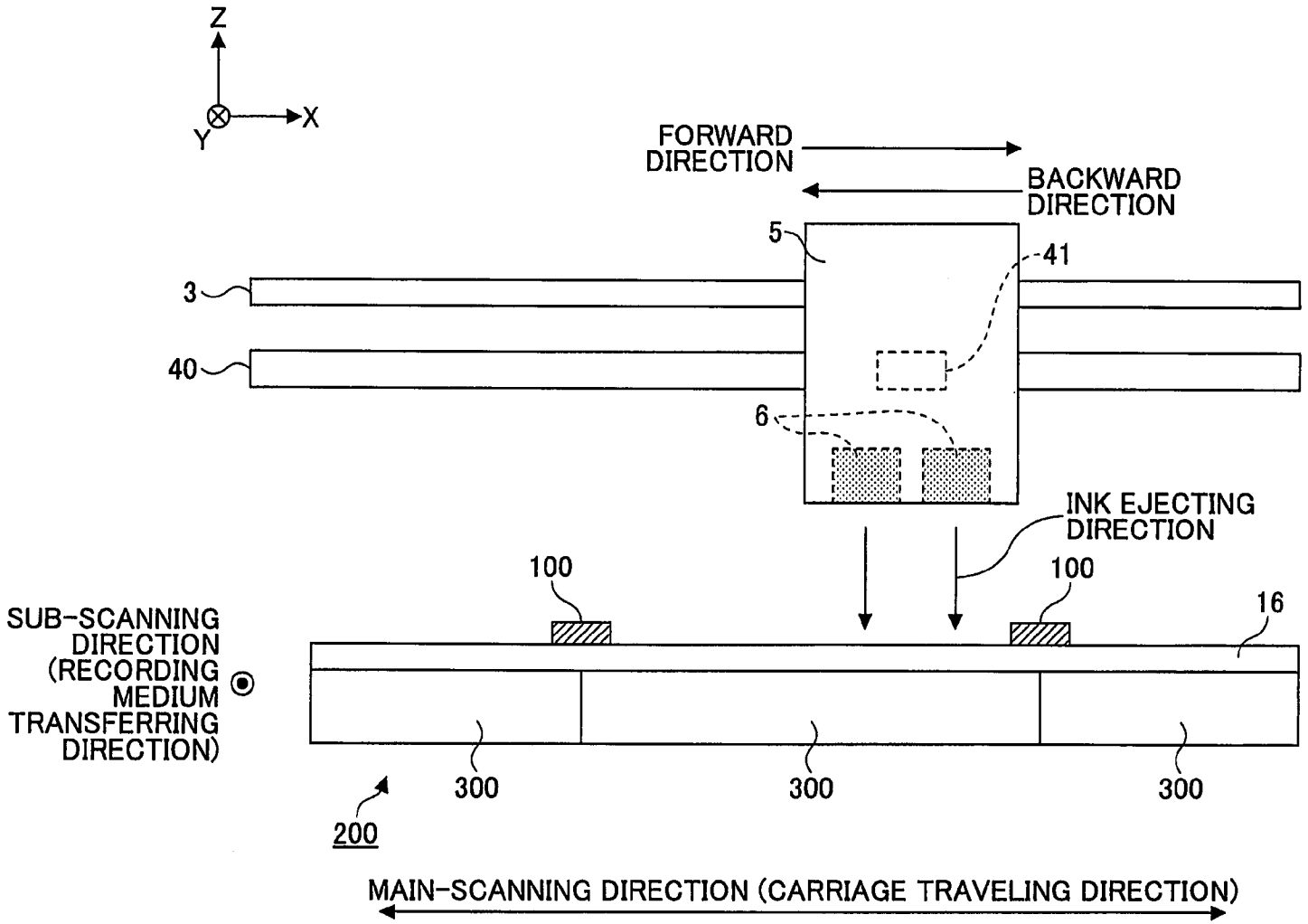
FIG. 3 is a second schematic configuration diagram illustrating the recording mechanism of the recording apparatus according to the first embodiment.
Figure 4:
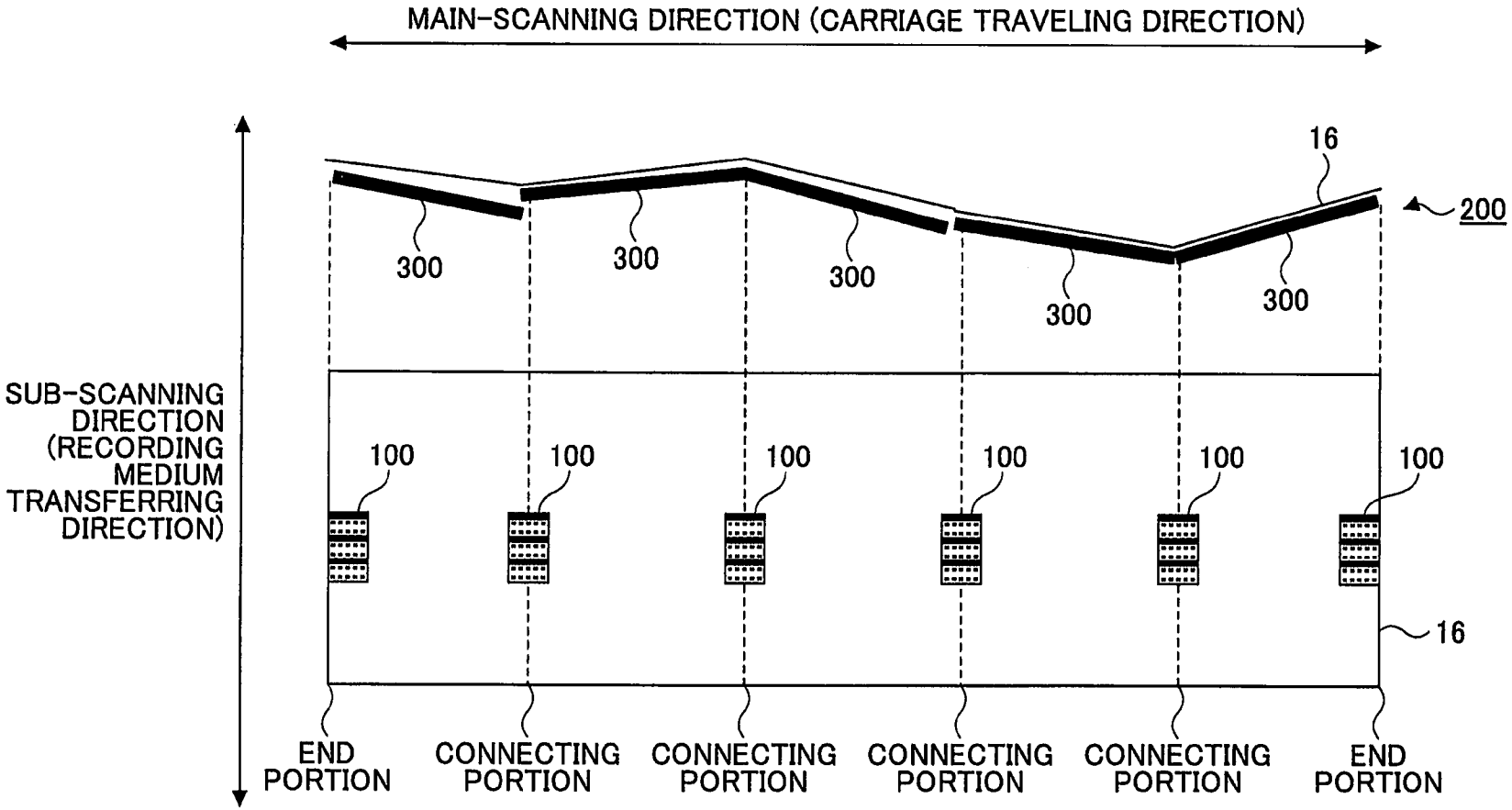
FIG. 4 is a configuration diagram illustrating a platen 200 and test patterns 100.

Next, a configuration example of a recording mechanism of the recording apparatus according to the first embodiment is described with reference to FIGS. 2 through 4. FIG. 2 is a top view of the carriage 5, FIG. 3 is a side view of the carriage 5, and FIG. 4 is a diagram illustrating a configuration example of the platen 200 and the test patterns 100.

The recording mechanism of the recording apparatus according to the first embodiment includes the carriage 5, the main supporting guide rod 3, the encoder sheet 40, and the platen 200. The carriage 5 includes the recording heads 6 and the encoder sensor 41.

The platen 200 is a supporting member to support the recording medium 16 while the ink is ejected onto the recording medium 16. The recording apparatus according to the first embodiment has a large width so that the carriage 5 can travel a long scanning travel distance in the main-scanning direction. Accordingly, the platen 200 is composed of the plural plate members 300 mutually connected in the main-scanning direction (i.e., carriage traveling direction) as illustrated in FIG. 4. If the platen 200 is composed of one large member, the platen 200 composed of one large member may result in low profile irregularity, or the cost of making the platen 200 with one large member may be high. Note that the platen 200 used in the first embodiment includes five mutually connected plate members 300.

The recording head 6 includes the plural nozzle arrays configured to eject ink onto the recording medium 16 that is transferred on the platen 200, thereby recording an image composed of dots on the recording medium 16. The recording mechanism according to the first embodiment moves the carriage 5 having the recording heads 6 in the main-scanning direction, and causes the nozzle arrays of the recording heads 6 to eject ink onto the recording medium 16 placed on the platen 200, thereby recording the test patterns 100 on the recording medium 16.

As illustrated in FIG. 4, the test patterns 100 are recorded at the positions of the recording medium 16 corresponding to both end portions of the platen 200 and connecting portions of the plate members 300 connected in the main-scanning direction. Accordingly, the number of test patterns 100 recorded on the recording medium 16 corresponds to the number of plate members 300 forming the platen 200. If the number of plate members 300 forming the platen 200 is N, the number of test patterns 100 to be recorded on the recording medium 16 is obtained by (N−1)+2. In FIG. 4, since five plate members 300 are connected to form the platen 200, the number of connecting portions is four, and the number of end portions of the platen 200 is 2. Accordingly, there are a total number of 6 positions on the recording medium 16 at which the test patterns 100 are to be recorded. That is, the number of test patterns 100 is obtained by (5−1)+2, resulting in 6.

Thus, since the recording apparatus according to the first embodiment is configured to record the test patterns 100, the number of which corresponds to the number of plate members 300 forming the platen 200, at respective positions of the plate members 300 in the main-scanning direction (i.e., carriage traveling direction) on the recording medium 16, a user may not have to set the positions on the recording medium 16 at which the test patterns 100 are to be recorded.

[Example of Test Pattern Recording Method]

Next, an example of a test pattern recording method is described with reference to FIGS. 5 through 7.

Figure 5:
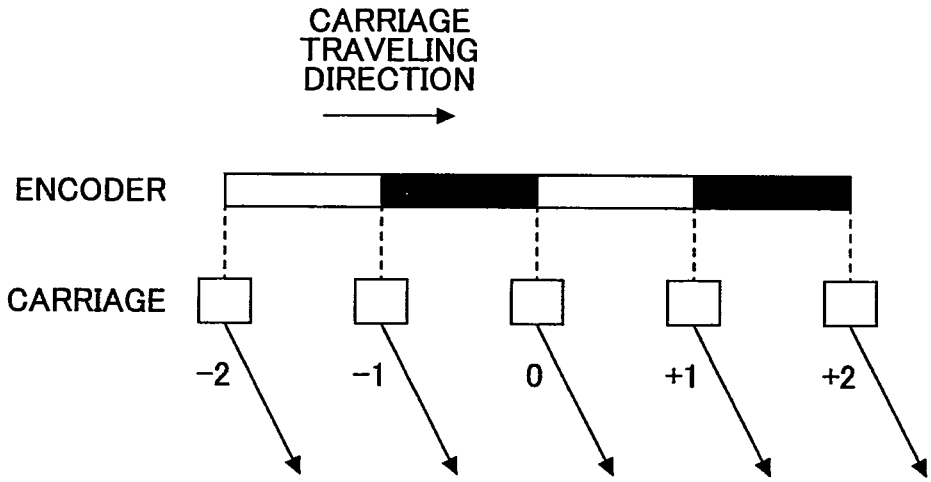
FIG. 5 is a first diagram illustrating an example of a recording method of test patterns 100.
Figure 6:
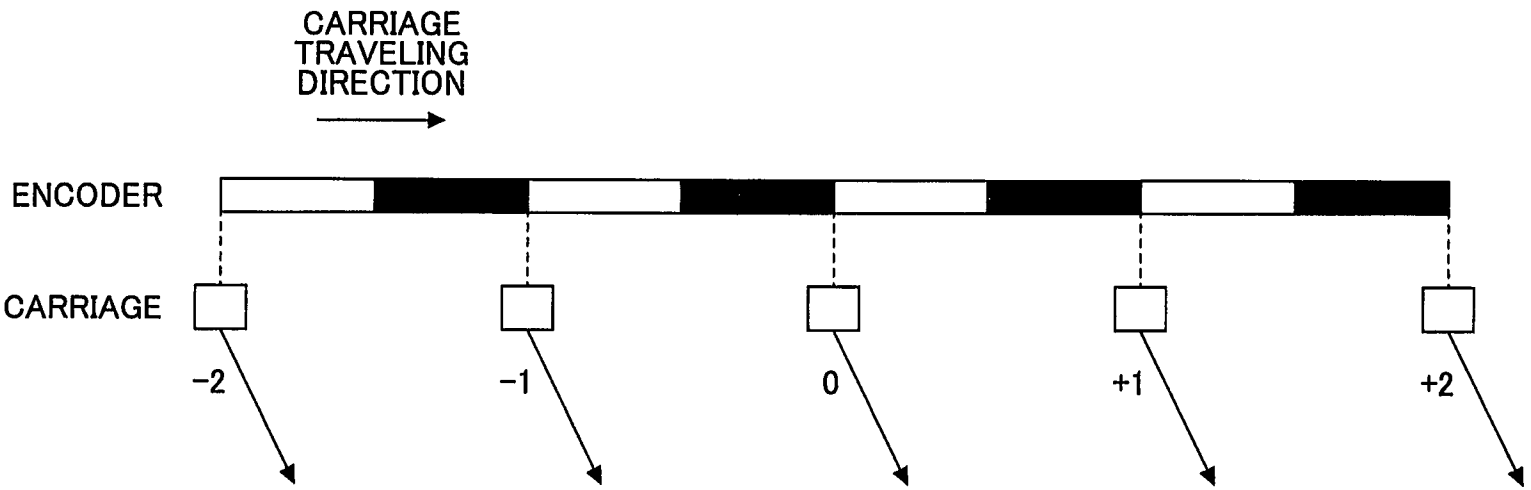
FIG. 6 is a second diagram illustrating an example of the recording method of the test patterns 100.

As illustrated in FIG. 5, when recording the test patterns 100, a position of an encoder value is 0, from which ½ encoder values that are shifted are +1 and −1 positions. FIG. 5 illustrates recording times for recording the test patterns 100 obtained by shifting a cycle of the encoder by a ¼ cycle. However, the recording times obtained by shifting a cycle of the encoder by a ¼ cycle are only an example and are not limited to those shifted by ¼ cycle as illustrated in FIG. 5. The recording times may be obtained by shifting the cycle of the encoder by a longer cycle than the ¼ cycle as illustrated in FIG. 6. Alternatively, the recording times may be obtained by shifting the cycle of the encoder by a shorter cycle than the ¼ cycle (not shown).

As illustrated in FIG. 7, with the recording apparatus according to the first embodiment, the test patterns 100 are recorded at the positions of the recording medium 16 corresponding to both end portions P1 and P6 of the platen 200 and connecting portions P2 through P5 of the plate members 300. The resolution of the encoder is 300 dpi, and vertical lines (pattern) forming each of the test patterns 100 are obtained by recording 600 dpi one-dot lines at one-dot intervals.

With the first scan (i.e., first forward traveling), forward traveling marks are recorded at a fixed time (e.g., one of −2 to +2 positions in FIG. 5), thereby recording a forward traveling mark array in the main-scanning direction.

With the second scan (i.e., first backward traveling), backward traveling marks are recorded at −2. position, thereby recording a backward traveling mark array in the main-scanning direction.

Accordingly, the test patterns 100 composed of the forward traveling marks and the backward traveling marks are recorded at predetermined positions of the recording medium 16 corresponding to both end portions P1 and P6 of the platen 200 and connecting portions P2 through P5 of the plate members 300 in the carriage traveling direction, so that the first carriage traveling direction pattern array 101 is recorded on the recording medium 16. Note that one test pattern 100 is composed of the forward traveling marks and the backward, traveling marks, and the carriage traveling direction pattern array 101 is composed of the forward traveling mark arrays and the backward traveling arrays.

Next, the recording medium 16 is transferred for the third scan (i.e., second forward traveling), where forward traveling marks are recorded at the same fixed time as the first scan, thereby recording a forward traveling mark array in the main-scanning direction.

With the fourth scan (i.e., second backward traveling), backward traveling marks are recorded at −1 position, thereby recording a backward traveling mark array in the main-scanning direction.

Accordingly, the test patterns 100 composed of the forward traveling marks and the backward traveling marks are recorded at the predetermined positions of the recording medium 16 corresponding to both end portions P1 and P6 of the platen 200 and connecting portions P2 through P5 of the plate members 300 in the carriage traveling direction, so that the second carriage traveling direction pattern array 101 is recorded on the recording medium 16.

Thereafter, in the odd-number scans, the forward traveling marks are recorded at the same fixed time as the first scan to record a forward traveling mark array in the main-scanning direction, whereas in the even-number scans, the backward traveling marks are recorded by shifting a position from 0 via +1 to +2 to record a backward traveling mark array in the main-scanning direction. As a result, the plural carriage traveling direction pattern arrays 101 are recorded in the sub-scanning direction to form a pattern group 102 composed of a group of the test patterns 100.

Accordingly, the recording apparatus according to the first embodiment records the test patterns 100 at the predetermined positions P1 to P6, the number of which corresponds to the number of the plate members 300 forming the platen 200, in the carriage traveling direction on the recording medium 16 supported on the recording medium 16 while scanning by reciprocating the carriage 5, thereby forming the carriage traveling direction pattern array 101. The recording apparatus then repeatedly records the carriage traveling direction pattern array 101 in the sub-scanning direction by relatively altering a recording time for each of the reciprocating scanning operations, thereby forming the pattern group 102 composed of a group of the test patterns 100.

There are no ink droplet misalignments if the backward traveling marks recorded in the backward traveling are overlapped with the forward traveling marks in the forward traveling and hence the test pattern 100 composed of a group of fine lines is formed on the recording medium 16. The example of FIG. 7 illustrates the respective test patterns 100 having no ink droplet misalignments occurring at 0 for P1, +1 for P2, 0 for P3, −1 for P4, +2 for P5, and +1 for P6.

Note that the test pattern 100 at −2 for P5 also seems to have no ink droplet misalignment. However, one dot is shifted in the one-dot line in this case. Accordingly, the test pattern 100 at −2 for P5 results in having an ink droplet misalignment.

Figure 8:
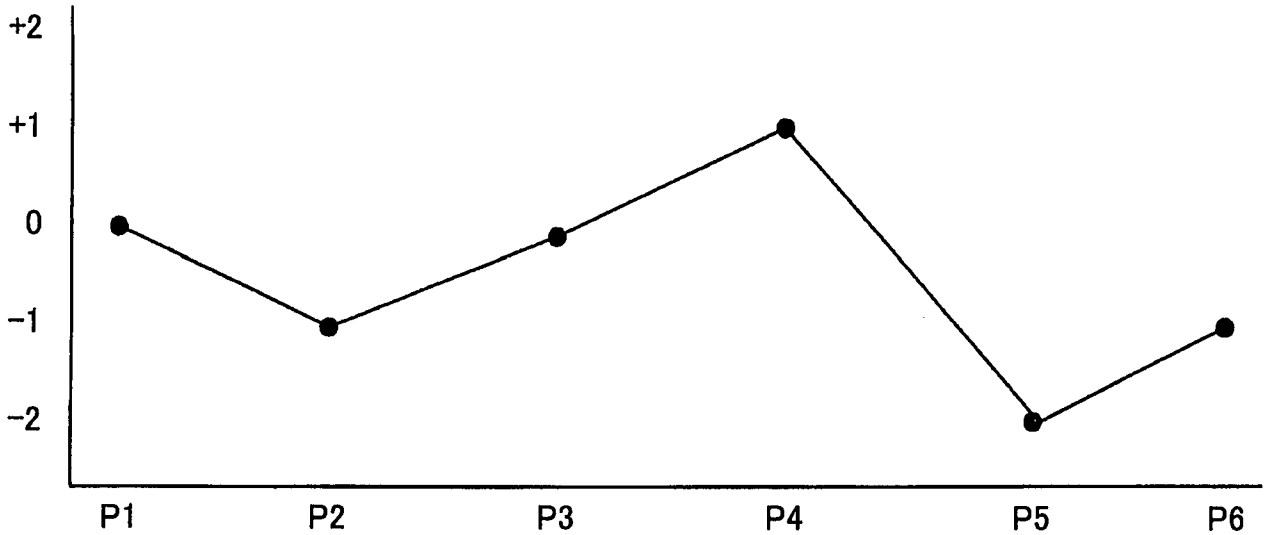
FIG. 8 is a diagram illustrating an ejecting time adjusting value obtained based on the test patterns 100.

In the first embodiment, the optimal test pattern 100 having no ink droplet misalignments may be selected from each of the transferring direction pattern arrays 103 composed of the plural test patterns 100 arranged in the sub-scanning direction by allowing the user to inspect the group of fine lines and the one-dot lines composing the test pattern 100 with the naked eye. Accordingly, an optimal ink ejecting time adjusting value at a position where the optimal test pattern 100 is recorded may be determined based on the optimal test pattern 100 selected by the user. The optimal ink ejecting time adjusting value is determined for each of the test patterns 100 recorded at the positions P1 through P6 in the main-scanning direction. In this manner, the optimal ink ejecting time adjusting values may be obtained for the positions P1 through P6 where the test patterns 100 are recorded in the main-scanning direction as illustrated in FIG. 8.

The ink ejecting time for the backward traveling may be obtained by linearly changing the ink ejecting time adjusting value for each of the intervals between adjacent points P1 to P6 to control the ink ejecting time based on the linearly changed ink ejecting time adjusting value. Accordingly, the ink droplet misalignments may be reduced in the entire main-scanning direction. Note that the ink ejecting time for the backward traveling is the same as the one already described.

[Configuration Example of Control Mechanism of Recording Apparatus]

Next, a configuration example of a control mechanism of the recording apparatus according to the first embodiment is described with reference to FIG. 9.

The control mechanism of the recording apparatus according to the first embodiment includes the control unit 107, a ROM 118, a RAM 119, a storage unit 120, an operation unit 121, the carriage 5, the main-scanning driver 109, the recording head 6, a recording head driver 111, the encoder sensor 41, the paper feed unit 112, and the sub-scanning driver 113.

The control unit 107 supplies recording data or driving control signals (pulse signals) to the storage unit 120 and the respective drivers, thereby controlling the entire recording apparatus. The control unit 107 controls the driving of the carriage 5 in the main-scanning direction via the main-scanning driver 109. The control unit 107 also controls the ink ejecting time for the recording head via the recording head driver 111. The control unit 107 also controls the driving of the paper feed unit 112 (e.g., a transfer belt) in the sub-scanning direction via the sub-scanning driver 113.

The operation unit 121 is configured to set the optimal test patterns 100 selected by the user from the transferring direction pattern arrays 103 illustrated in FIG. 7. The optimal test patterns 100 are set for the positions P1 through P6 where the test patterns 100 are recorded in the main-scanning direction. In this manner, the control unit 107 obtains the optimal ink ejecting time adjusting values for the positions P1 through P6 where the test patterns 100 are recorded in the main-scanning direction as illustrated in FIG. 8. The control unit 107 adjusts the ink ejecting time for the recording head 6 based on the optimal ink ejecting time adjusting values for the positions P1 through P6.

The encoder sensor 41 detects an encoder mark to output an encoder value obtained based on the mark on the encoder sheet 40 to the control unit 107. The control unit 107 controls the driving of the carriage 5 in-the main-scanning direction via the main-scanning driver 109 based on the obtained encoder value.

The ROM 118 is configured to store desired information. For example, the ROM 118 stores computer programs such as processing instructions to be executed by the control unit 107. The RAM 119 is used as a working memory or the like.

[Ejecting Time Adjusting Method]

Next, an ink ejecting time adjusting method according to the first embodiment is described with reference to FIG. 10.

The control unit 107 controls the driving of the carriage 5 such that the test patterns 100 are recorded at the predetermined positions P1 through P6, the number of which corresponds to the number of the plate members 300 forming the platen 200, in the carriage traveling direction on the recording medium 16, thereby obtaining the carriage traveling direction pattern array 101. Note that the test pattern 100 is composed of the forward traveling marks recorded in the forward traveling of the carriage 5 and the backward traveling marks recorded in the backward traveling of the carriage 5, and the carriage traveling direction pattern array 101 is composed of the number of the test patterns 100 corresponding to the number of the plate members 300 forming the platen 200 that are recorded at the predetermined positions P1 through P6 in the carriage traveling direction. The control unit 107 controls the driving of the carriage 5 to relatively move the recording positions of the forward traveling marks recorded in the forward traveling of the carriage 5 and the recording positions of the backward traveling marks recorded in the backward traveling of the carriage 5, so that the plural carriage traveling direction patterns 101 are recorded in the sub-scanning direction (recording medium transferring direction). Accordingly, the pattern group 102 composed of a group of the test patterns 100 may be obtained (step A1). Thus, as illustrated in FIG. 7, the test patterns 100 are recorded at the predetermined positions P1 through P6, the number of which corresponds to the number of the plate members 300 forming the platen 200, in the carriage traveling direction.

The user selects the optimal test pattern 100 having no ink droplet misalignments from each of the transferring direction pattern arrays 103 composed of the plural test patterns 100 arranged in the sub-scanning directions by observing the transferring direction pattern arrays 103 composed of the plural test patterns 100 arranged in the sub-scanning directions with the naked eye (step A2). The user selects the optimal test pattern 100 from the test patterns 100 recorded at each of the positions P1 through P6 in the main-scanning direction. The user sets optimal test pattern 100 information via the operation unit 121.

The control unit 107 determines the optimal, ink ejecting time adjusting values for the positions P1 through P6 where the test patterns 100 are recorded in the main-scanning direction based on the optimal test pattern 100 information set by the user via the operation unit 121 (step A3). In this manner, the control unit 107 determines the optimal ink ejecting time adjusting values for the positions P1 through P6 where the test patterns 100 are recorded in the main-scanning direction as illustrated in FIG. 8.

The control unit 107 linearly interpolates between the optimal ink ejecting time adjusting values illustrated in FIG. 8 and computes a linearly interpolated ejecting time value for each of the intervals between adjacent points P1 through P6 based on the linear interpolation between the optimal ink ejecting time adjusting values (A4).

The control unit 107 controls the ink ejecting time for the recording head 6 based on the linearly interpolated ejecting time value for each of the intervals between adjacent points P1 through P6 based on the linear interpolation between the optimal ink ejecting time adjusting values (step A5).

[Recording Head Ejecting Time Adjusting Method]

Figure 11A:
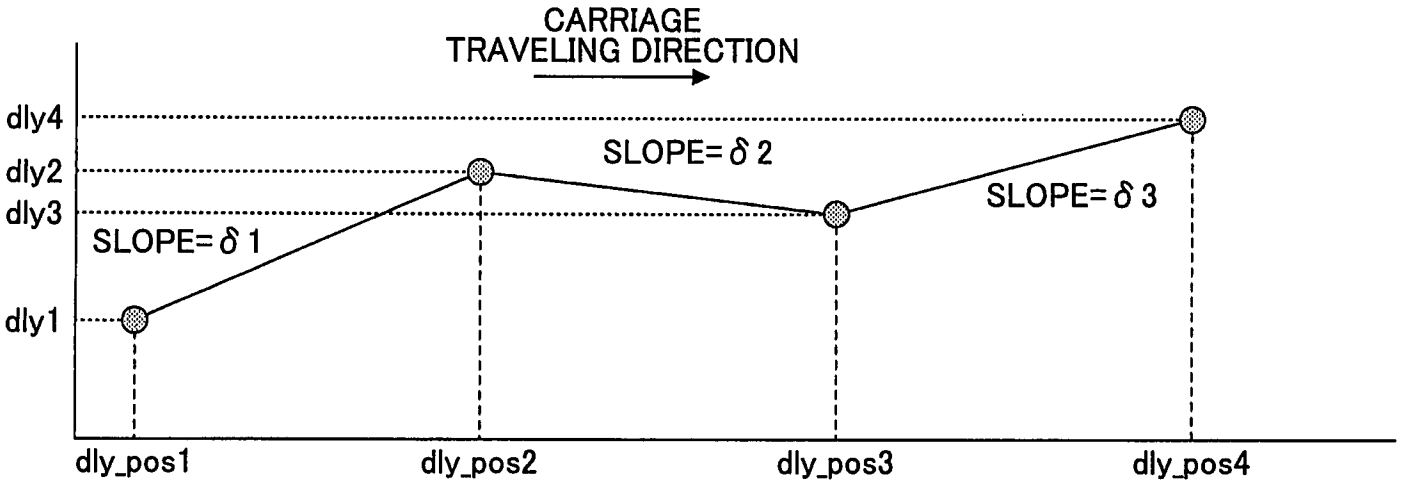
FIGS. 11A and 11B are diagrams illustrating a relationship between encoder values (dly_pos1 to dly_pos4) of the test patterns 100 and ejecting time adjusting values (dly1 to dly4, dly'4 to dly'1)
Figure 11B:
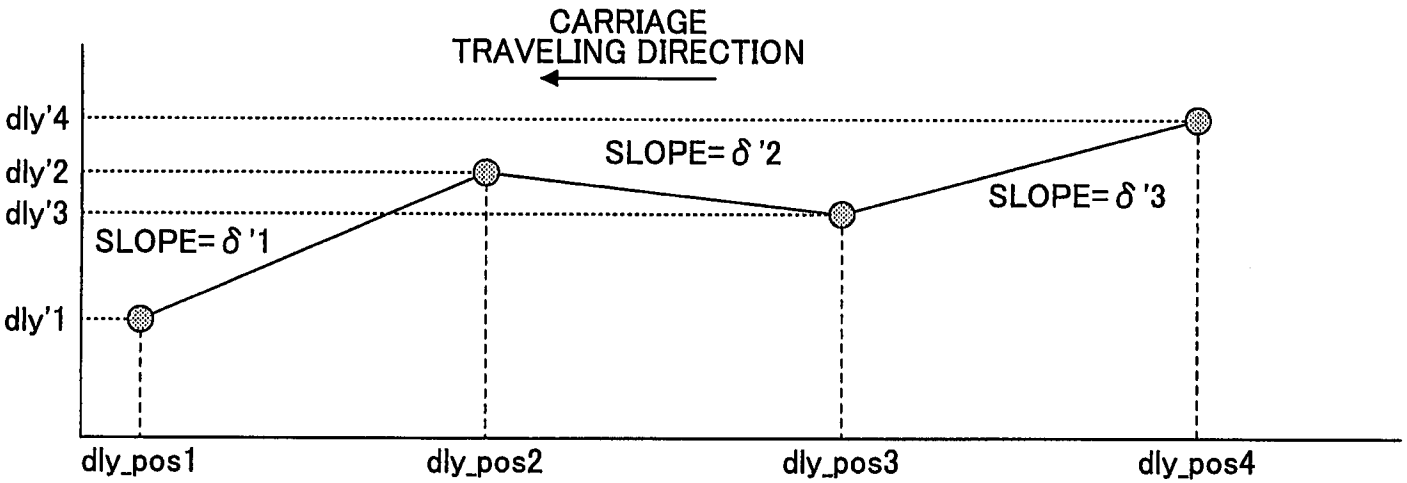
Figure 12A:
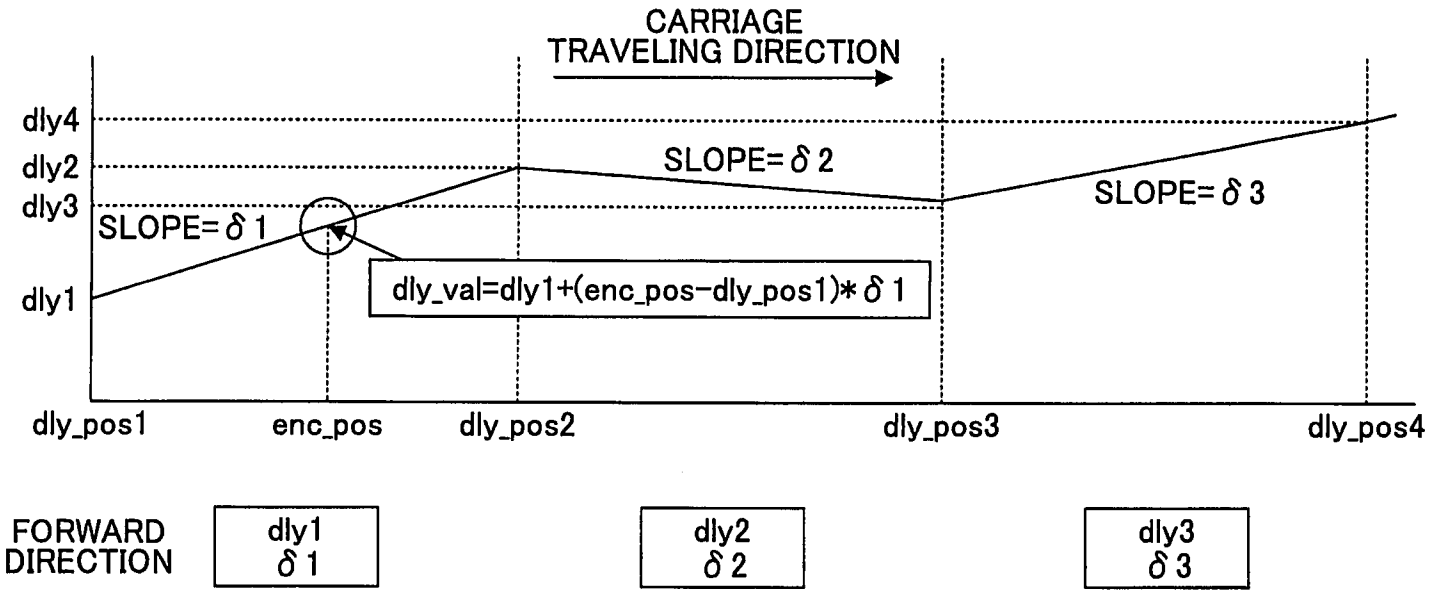
FIGS. 12A and 12B are diagrams illustrating an ejecting time adjusting value (dly_val) used at a desired scanning position (enc_pos)
Figure 12B:
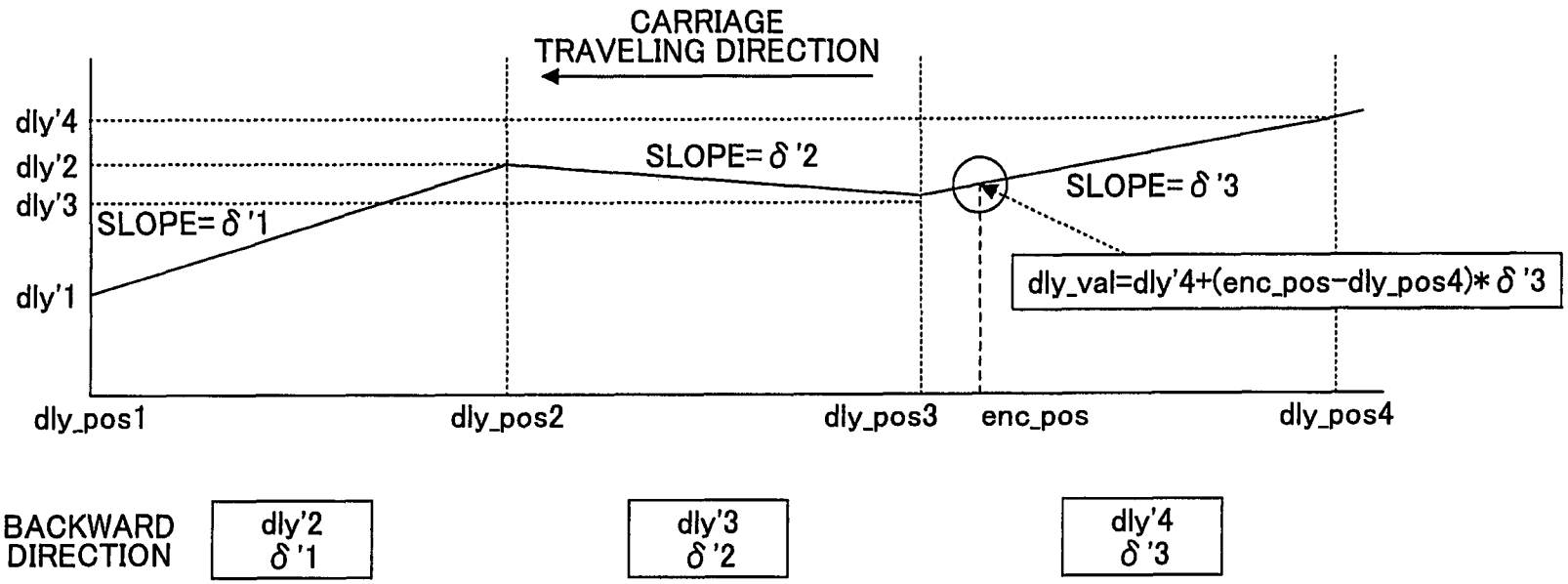
Figure 13:
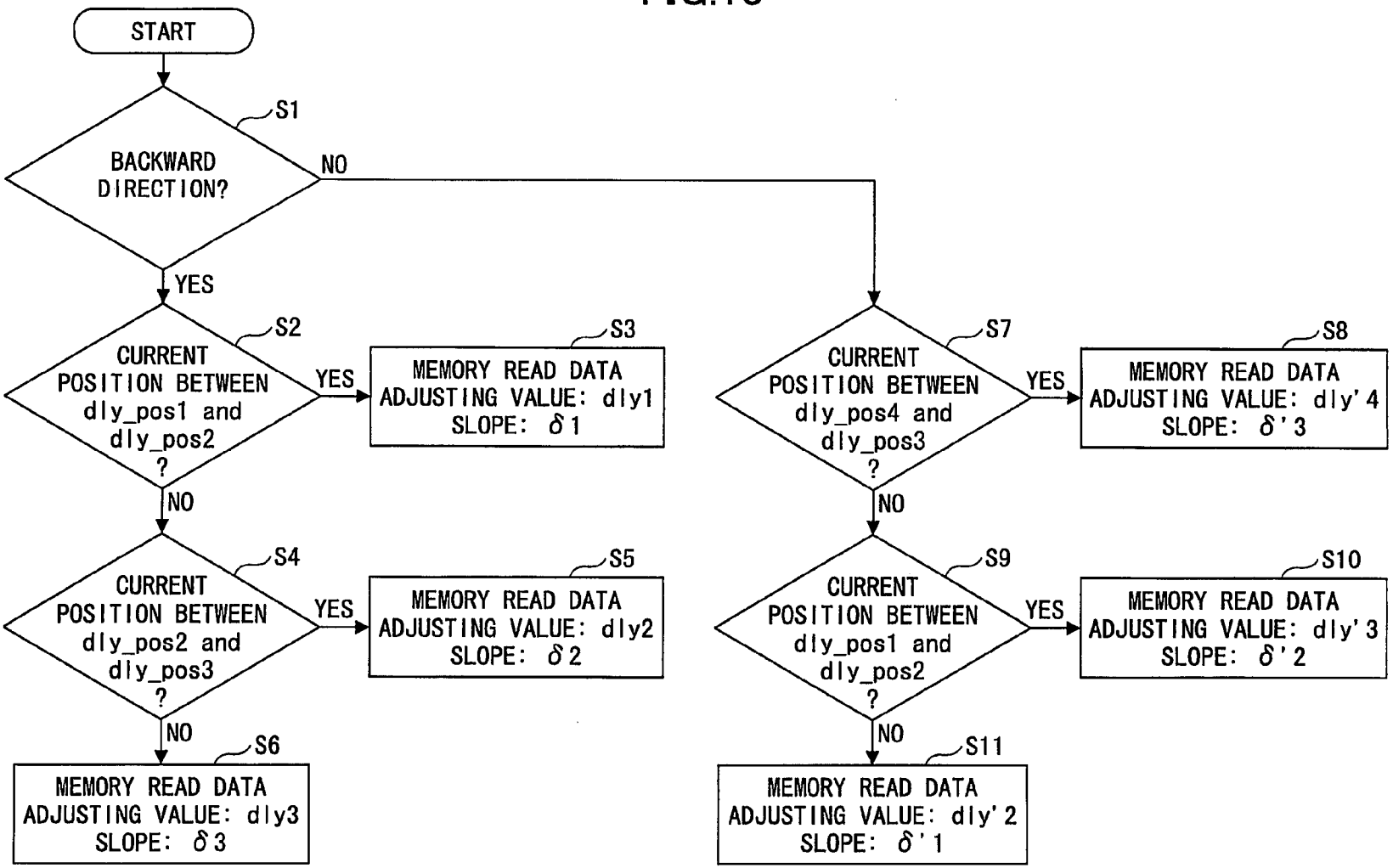
FIG. 13 is a diagram illustrating a process in which an ejecting time adjusting value (dly) and a slope (δ) are determined when the ejecting time adjusting value (dly_val) is computed.
Figure 14:
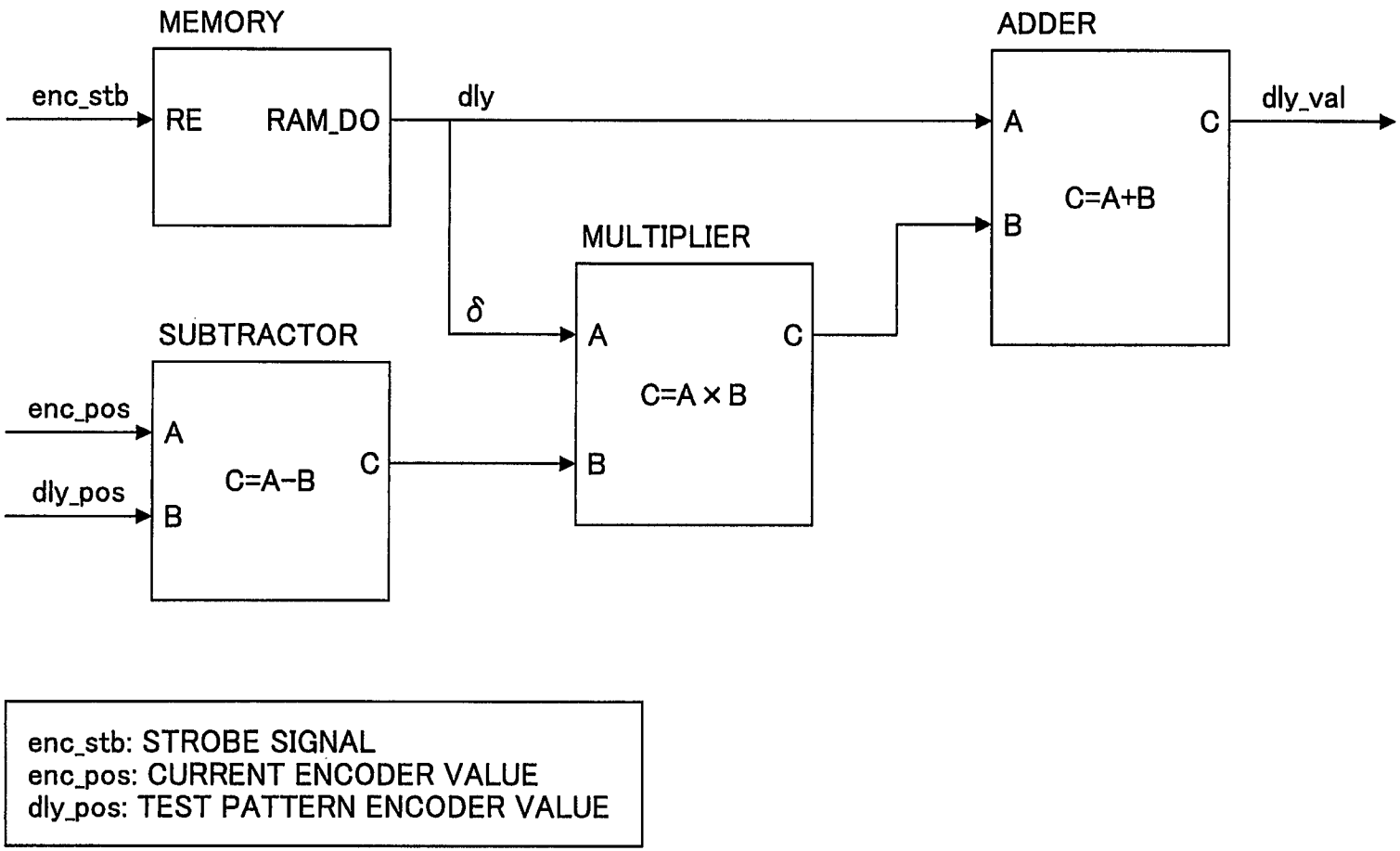
FIG. 14 is a configuration diagram illustrating an example of a calculator circuit to calculate the ejecting time adjusting value (dly_val) used at the desired scanning position (enc_pos)

Next, an ink ejecting time adjusting method for the recording head 6 is described with reference to FIGS. 11A through FIG. 14. Note that the number of plate members 300 is determined as N=4 in an example of the following description. FIGS. 11A and 11B are diagrams illustrating a relationship between encoder values (dly_pos1 to dly_pos4) of the test patterns 100 and ejecting time adjusting values (dly1 to dly4, dly'4 to dly'1). FIGS. 12A and 12B are diagrams illustrating an ejecting time adjusting value (dly_val) used at a desired scanning position (enc_pos). FIG. 13 is a diagram illustrating a process in which an ejecting time adjusting value (dly) and a slope (δ) are determined when the ejecting time adjusting value (dly_val) is computed. FIG. 14 is a configuration diagram illustrating an example of a calculator circuit to calculate the ejecting time adjusting value (dly_val) used at the desired scanning position (enc_pos). Note that the values shown in FIGS. 11A, 11B, 12A, and 12B are obtained when the platen 200 is composed of the mutually connected plate members 300 in the main-scanning direction.

In the recording apparatus according to the first embodiment, the user observes the recorded test patterns 100 with the naked eye and selects the optimal test pattern 100 having no ink droplet misalignments from each of the transferring direction pattern arrays 103 recorded at the positions P1 through P6 (see FIG. 7) in the main-scanning direction. Accordingly, the optimal ink ejecting time adjusting values are obtained based on the transferring direction pattern arrays 103 recorded at the positions P1 through P6 on the recording medium 16. FIG. 11A illustrates ejecting time adjusting values (dly1 to dly4) when the carriage 5 is moved in the forward traveling direction. FIG. 11B illustrates ejecting time adjusting values (dly'4 to dly'1) when the carriage 5 is moved in the backward traveling direction.

The recording apparatus according to the first embodiment computes slopes δ between adjacent test patterns 100 based on the corresponding ejecting time adjusting values (dly1 to dly4, dly'4 to dly'1) for the test patterns 100 and the corresponding encoder values (dly_pos1 to dly_pos4) of the test patterns 100. For example, a slope δ between the first test pattern dly_pos1 and the second test pattern dly_pos2 is obtained by the following equation.

$$\delta 1=(dly2-dly1)/(dly_pos2-dly_pos1)$$

In the above equation, δ1 represents a slope between the first test pattern dly_pos1 and the second test pattern dly_pos2, dly2 represents an ejecting time adjusting value obtained for the second test pattern dly_pos2, dly1 represents an ejecting time adjusting value obtained for the first test pattern dly_pos1, dly_pos1 represents an encoder value for the first test pattern, and dly_pos2 represents an encoder value for the second test pattern.

The recording apparatus according to the first embodiment computes the slopes δ between the adjacent test patterns 100, linearly interpolates between the ejecting time adjusting values dly1 to dly4 and dly'4 to dly'1 obtained from the test patterns 100 based on the obtained slopes δ and the ejecting time adjusting values dly1 to dly4 and dly'4 to dly'1, and controls ink ejecting times based on ejecting time adjusting values (dly_val) obtained by the linear interpolation between the ejecting time adjusting values dly1 to dly4 and dly'4 to dly'1, as illustrated in FIG. 12. Accordingly, it is possible to reduce the ink droplet misalignments on the recording medium 16 in the entire main-scanning direction when the relative distance between the platen 200 and the carriage 5 varies with the position of the carriage 5 in the main-scanning direction.

Note that the ejecting time adjusting value dly and the corresponding slope δ used when the ejecting time adjusting value (dly_val) is computed are determined by following the processing illustrated in FIG. 13.

As illustrated, in FIG. 13, the control unit 107 determines whether a traveling direction of the carriage 5 is the forward traveling direction or the backward traveling direction (step S1). If the traveling direction of the carriage 5 is the forward traveling direction (Yes in step S1), the control unit 107 determines whether a current position (encoder value enc_pos) of the carriage 5 is between dly_pos1 and dly_pos2 (step S2).

If the current position (encoder value enc_pos) of the carriage 5 is between dly_pos1 and dly_pos2 (step S2), the control unit 107 employs an ejecting time adjusting value dly1 and a corresponding slope δ1 associated with dly_pos1 (step S3).

By contrast, if the current position (encoder value enc_pos) of the carriage 5 is not between dly_pos1 and dly_pos2 (No in step S2), the control unit 107 determines whether the current position (encoder value enc_pos) of the carriage 5 is between dly_pos2 and dly_pos3 (step S4).

If the current position (encoder value enc_pos) of the carriage 5 is between dly_pos2 and dly_pos3 (Yes in step S4), the control unit 107 employs an ejecting time adjusting value dly2 and a corresponding slope δ2 associated with dly_pos2 (step S5).

Further, if the current position (encoder value enc_pos) of the carriage 5 is not between dly_pos2 and dly_pos3 (No in step S4), the control unit 107 determines that the current position (encoder value enc_pos) of the carriage 5 is between dly_pos3 and dly_pos4 and employs an ejecting time adjusting value dly3 and a corresponding slope δ3 associated with dly_pos3 (step S6).

Meanwhile, if the traveling direction of the carriage 5 is the backward traveling direction (No in step S1), the control. unit 107 determines whether the current position (i.e., encoder value enc_pos) of the carriage 5 is between dly_pos4 and dly_pos3 (step S7).

If the current position (encoder value enc_pos) of the carriage 5 is between dly_pos4 and dly_pos3 (Yes in step S7), the control unit 107 employs an ejecting time adjusting value dly'4 and a corresponding slope δ'3 associated with dly_pos4 (step S8).

By contrast, if the current position (encoder value enc_pos) of the carriage 5 is not between dly_pos4 and dly_pos3 (No in step S7), the control unit 107 determines whether the current position (encoder value enc_pos) of the carriage 5 is between dly_pos3 and dly_pos2 (step S9).

If the current position (encoder value enc_pos) of the carriage 5 is between dly_pos3 and dly_pos2 (Yes in step S9), the control unit 107 employs an ejecting time adjusting value dly'3 and a corresponding slope δ'2 associated with dly_pos3 (step S10).

Further, if the current position (encoder value enc_pos) of the carriage 5 is not between dly_pos3 and dly_pos2 (No in step S9), the control unit 107 determines that the current position (encoder value enc_pos) of the carriage 5 is between dly_pos2 and dly_pos1 and employs an ejecting time adjusting value dly'2 and a corresponding slope δ'1 associated with dly_pos2 (step S11). Thus, the control unit 107 can determine the ejecting time adjusting value dly and the corresponding slope δ based on the current position (encoder value enc_pos) of the carriage 5.

FIG. 14 illustrates a calculator circuit to calculate the ejecting time adjusting value (dly_val) used at a desired scanning position (enc_pos). As illustrated in FIG. 14, the calculator circuit includes a memory, a subtractor, a multiplier, and an adder.

The memory manages a correspondence table illustrated in FIG. 15 and refers to the correspondence table in order to output an appropriate ejecting time adjusting value dly and a corresponding slope δ based on the address information for every time a strobe signal enc_stb is input to the memory. The ejecting time adjusting value dly is output to the adder and the corresponding slope δ is output to the multiplier. The strobe signal enc_stb is obtained every encoder cycle, and is obtained for every time the encoder value obtained by the encoder sensor 41 is changed by a predetermined value. For example, when the encoder value obtained by the encoder sensor 41 is changed from p1 to p2, the strobe signal enc_stb is input to the memory.

When the carriage 5 travels in a period between the positions dly_pos1 and dly_pos2 in the forward traveling direction, the memory refers to address information 1 and outputs the ejecting time adjusting value dly1 and the corresponding slope δ1 associated with dly_pos1 for the forward traveling direction. Further, when the carriage 5 travels in a period between the positions dly_pos2 and dly_pos3, the memory refers to address information 2 and outputs the ejecting time adjusting value dly2 and the corresponding slope δ2 associated with dly_pos2 for the forward traveling direction. Moreover, when the carriage 5 travels in a period between the positions dly_pos3 and dly_pos4, the memory refers to address information 3 and outputs the ejecting time adjusting value dly3 and the corresponding slope δ3 associated with dly_pos3 for the forward traveling direction.

By contrast, when the carriage 5 travels in a period between the positions dly_pos4 and dly_pos3 in the backward traveling direction, the memory refers to address information 4' and outputs the ejecting time adjusting value dly'4 and the corresponding slope δ'3 associated with. dly_pos4 for the backward traveling direction. When the carriage 5 travels in a period between the positions dly_pos3 and dly_pos2, the memory refers to address information 3' and outputs the ejecting time adjusting value dly'3 and the corresponding slope δ'2 associated with dly_pos3 for the backward traveling direction. Further, when the carriage 5 travels in a period between the positions dly_pos2 and dly_pos1, the memory refers to address information 2' and outputs the ejecting time adjusting value dly'2 and the corresponding slope δ'1 associated with dly_pos2 for the backward traveling direction.

The subtractor computes the difference (enc_pos−dly_pos) between the positions enc_pos and dly_pos input thereto and sends the computed difference (enc_pos−dly_pos) to the multiplier. Note that the position enc_pos indicates the current position (i.e., encoder value) of the carriage 5, and the position dly_pos indicates the encoder value of the test pattern 100. For example, the positions dly_pos1, dly_pos2, and dly_pos3 represent the respective encoder values of the first, second, and third test patterns 100.

The multiplier multiplies the slope δ input from the memory by the difference (enc_pos−dly_pos) input from the subtractor to compute the product (multiplied value), which is output to the adder.

The adder adds the ejecting time adjusting value dly input from the memory and the computed product (i.e., multiplied value) input from the multiplier to compute the sum (dly+(enc_pos−dly_pos * δ)) to obtain the value dly_val. The value dly_val indicates an ink ejecting time adjusting value for actually recording the test pattern 100 on the recording medium 16.

Note that in this embodiment, the multiplied value del_val is computed by the calculator circuit; however, the value del_val may be computed by a computer program that can obtain the value del_val computed by the calculator circuit.

[Reduction in Ink Droplet Misalignments]

Next, a process for reducing ink droplet misalignments by linearly interpolating between the ink ejecting time adjusting values is described.

Figure 16:
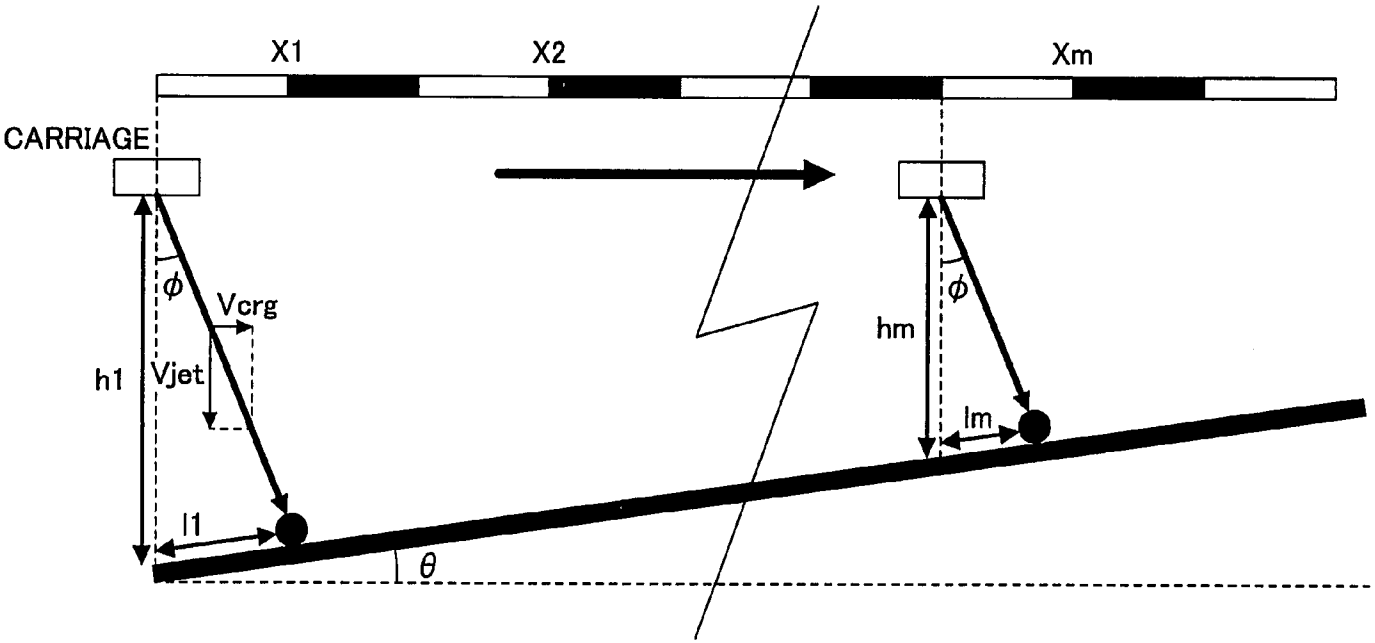
FIG. 16 is a first diagram illustrating a process in which ink droplet misalignments in printing are reduced.

As illustrated in FIG. 16, the change in the ink ejecting distance when the platen 200 is tilted at 0 degrees is initially computed.

FIG. 16 illustrates the following relationship:

$$\tan\phi=(h1-hm)/(xm-x1),\ \text{which results in}\ hm=h1-(xm-x1)\tan\theta \quad (1)$$

Figure 17:
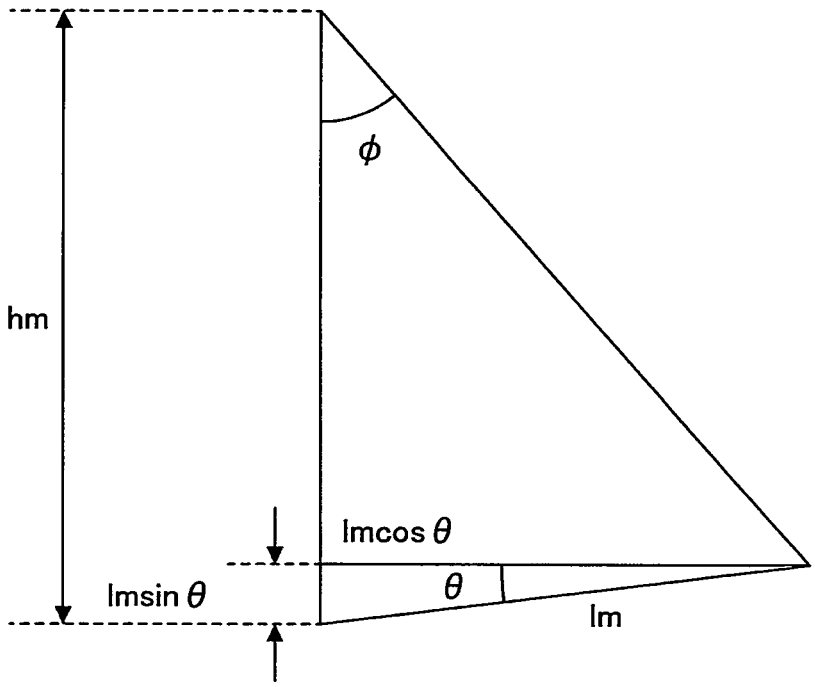
FIG. 17 is a second diagram illustrating a process in which ink droplet misalignments in printing are reduced.

Further, FIG. 17 indicates the following relationship:

$$\tan\phi=lm\cos\theta/(hm-lm\sin\theta),\ \text{which results in}\ lm=hm\tan\phi/(\cos\theta+\tan\phi\sin\theta) \quad (2)$$

By substituting formula (1) into formula (2), the following equation is obtained.

$$lm=(h1-(xm-x1)\tan\theta)\tan\theta/(\cos\theta+\tan\mathbf{100}\sin\theta)$$

When the above equation is replaced by the following A and B:

$$A=-\tan\theta\tan\phi/(\cos\theta+\tan\phi\sin\theta);\ \text{and}$$

$$B=h1\tan\phi/(\cos\theta+\tan\phi\sin\theta),$$

the following equation is obtained.

$$lm=A(xm-x1)+B\ (\text{wherein}\ A,\ \text{and}\ B\ \text{are a constant number}) \quad (3)$$

From the above equation, the ink ejection distance is changed when the platen 200 is tilted based on linear function of the traveled amount of the carriage 5.

Figure 18:
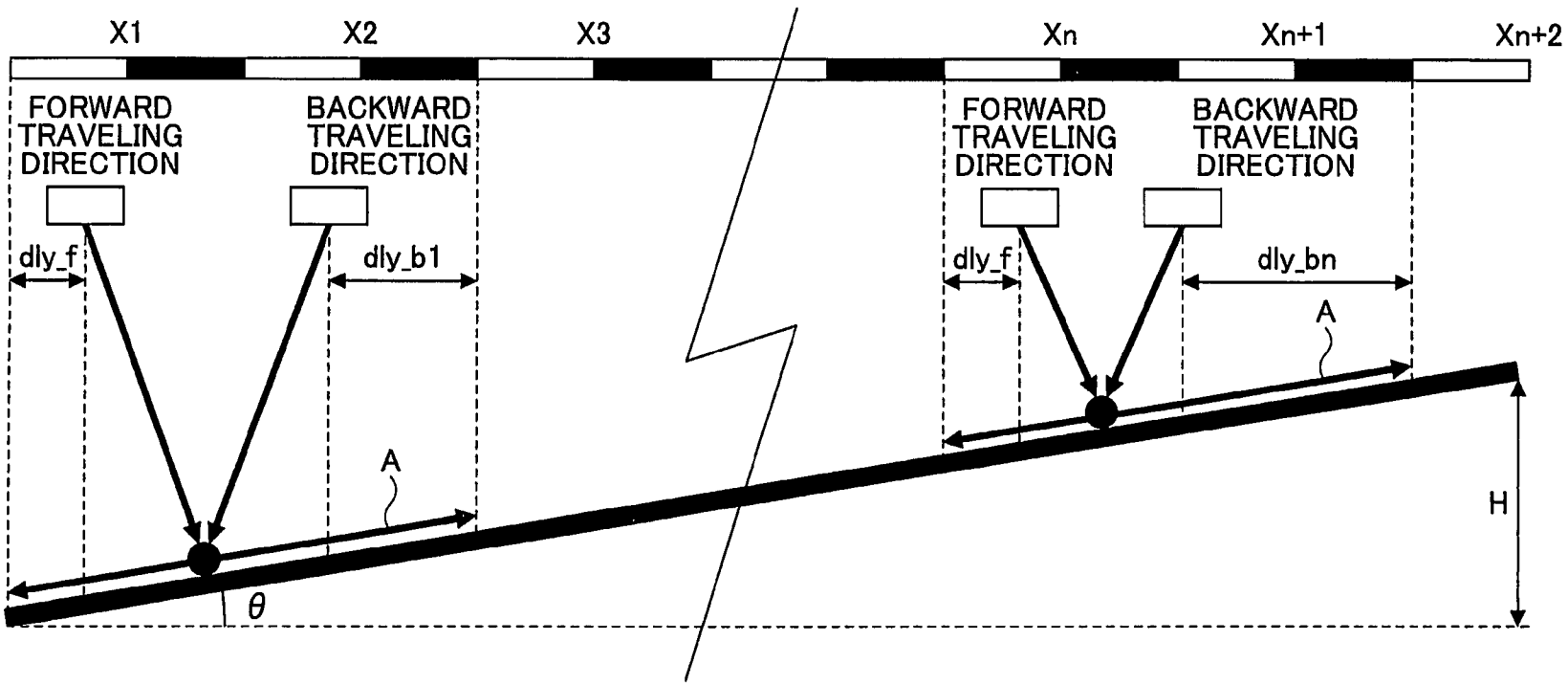
FIG. 18 is a third diagram illustrating a process in which ink droplet misalignments in printing are reduced.

Next, controlling the ink ejecting time for recording in the backward traveling direction when the ink ejecting time for recording in the forward traveling direction is constant is examined in order to reduce ink droplet misalignments. Note that the ink ejecting time for printing in the backward traveling direction is delayed from the ink ejecting time for printing in the forward traveling direction based on a position at which two encoder cycles have been completed, as illustrated in FIG. 18.

Then, based on the fact that the two lengths "A" are the same lengths, from the above equation (3), the following equation (4) is obtained.

$$dly_f/\cos\theta+A(x1-x1+dly_f)+B+A'(x3-x1-dly_b1)+B'+dly_b1/\cos\theta=dly_f/\cos\theta+A(xn-x1+dly_f)+B+A'(xn+2-x1-dly_bn)+B'+dly_bn/\cos\theta \quad (4)$$

From the above equation (3), the following A' and B' are obtained.

$$A'=-\tan\theta\tan\phi)/(\cos\theta-\tan\phi\sin\theta)$$

$$B'=h1\tan\phi/(\cos\theta-\tan\phi\sin\theta)$$

In summarizing equation (4), the following equation is obtained.

$$0=A(xn-x1)+A'(xn+2-x3)+dly_bn(1/\cos\theta-A')-dly_b1(1/\cos\theta-A')$$

Further, the above is rearranged based on "xn−x1=xn+2−x3", so that the following equation is obtained.

$$dn=d1-(A+A')(xn-x1)/(1/\cos\theta-A'),$$

wherein dn represents dly_bn, and d1 represents dly_b1.

When the above equation is replaced by equation C=−(A+A')/(1/cos θ−A'), the following equation is obtained.

$$dn=d1+(xn-x1)C \quad (5)$$

From equation (5), the optional integer m that satisfies the condition 1≦m≦n is obtained by the following equation.

$$dm=d1+(xm-x1)*(dn-d1)/(xn-x1) \quad (6)$$

Figure 19:
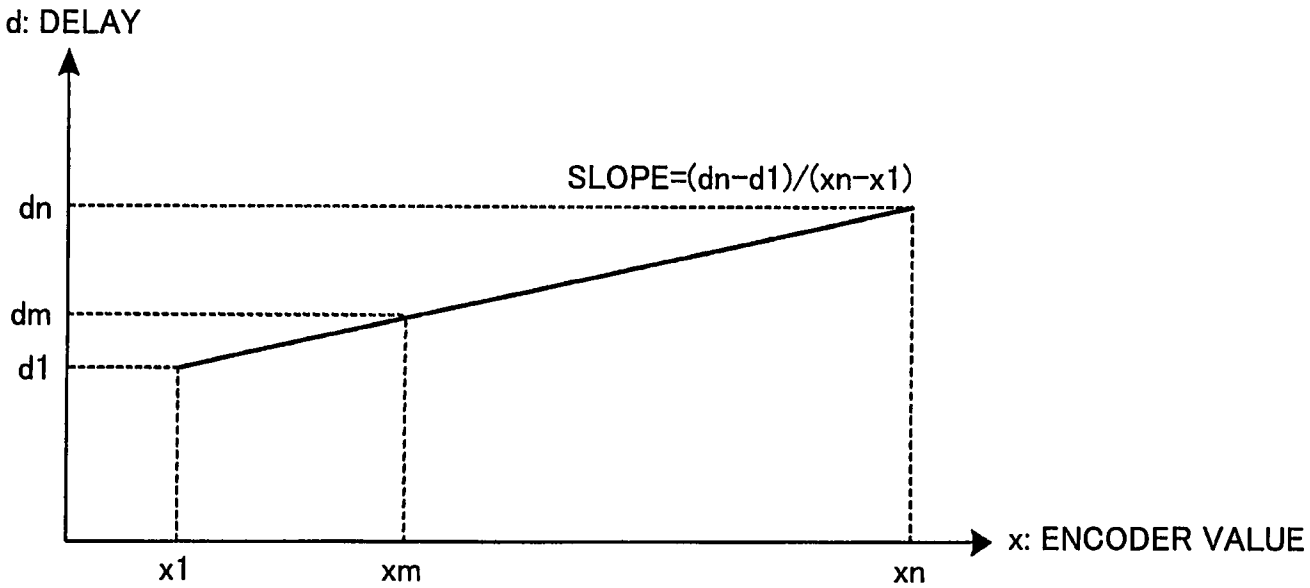
FIG. 19 is a fourth diagram illustrating a process in which ink droplet misalignments in printing are reduced.

The relationship expressed by the above equation (6) is illustrated in FIG. 19.

As illustrated in FIG. 19, the ink droplet misalignments occurring in printing forward and backward traveling directions due to tilting of the platen 200 may be reduced by linearly changing the delay in printing in the backward traveling direction, when the delay in printing in the forward traveling direction is constant.

Note that in the above example, the ink ejecting time is controlled such that the ink is ejected in recording in the backward traveling direction after the carriage 5 has traveled two encoder cycles. However, as can be understood from equation (3), the ink ejecting time is not limited to the time after the carriage has traveled two encoder cycles.

[Interaction and Effect of Recording Apparatus]

As described above, the recording apparatus according to the first embodiment records the test patterns 100, the number of which corresponds to the number of plate members 300 forming the platen 200, at the respective positions of the plate members 300 in the main-scanning direction (carriage traveling direction) on the recording medium 16 supported by the platen 200, and determines the ink ejecting time adjusting values at the positions where the test patterns 100 are recorded on the recording medium 16. The recording apparatus according to the first embodiment then linearly interpolates between the ink ejecting time adjusting values determined based on the test patterns 100, and the ink ejecting times are controlled based on ejecting time adjusting values obtained by the linear interpolation between the ink ejecting time adjusting values.

Accordingly, in the recording apparatus according to the first embodiment including the platen 200 composed of the plural plate members 300 connected in the main-scanning direction (carriage traveling direction), it is possible to reduce the ink droplet misalignments occurring due to the changes in relative distances between the plural plate members 300 of the platen 200 and the carriage 5 in the main-scanning direction.

[Second Embodiment]

Next, a recording apparatus according to a second embodiment is described.

In the recording apparatus according to the first embodiment, the user observes (inspects) the recorded test patterns 100 with the naked eye and selects the optimal test pattern 100 having no ink droplet misalignments from each of the transferring direction pattern arrays 103 recorded at the positions P1 through P6 (see FIG. 10) in the main-scanning direction (step A2), and the optimal ink ejecting time adjusting values are determined based on the corresponding transferring direction pattern arrays 103 recorded at the positions P1 through P6 on the recording medium 16 (step A3).

Figure 20:
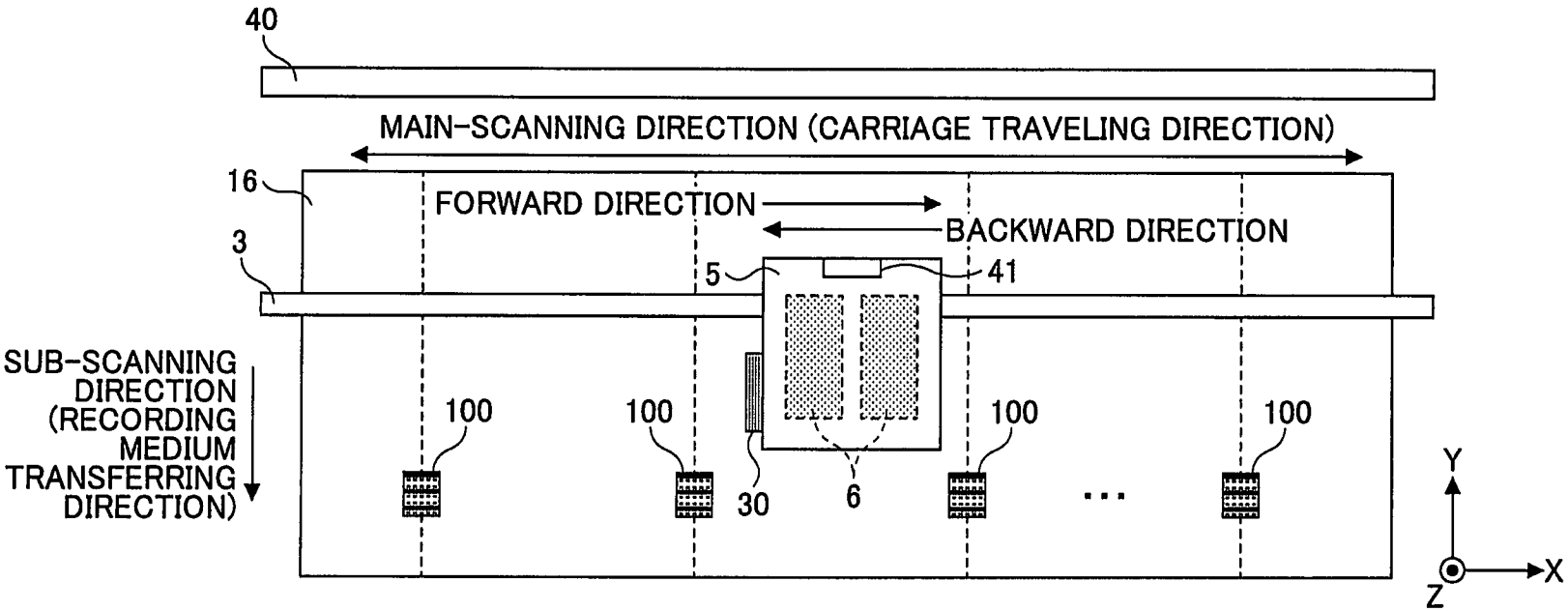
FIG. 20 is a schematic configuration diagram illustrating a recording mechanism of a recording apparatus according to a second embodiment.
Figure 23:
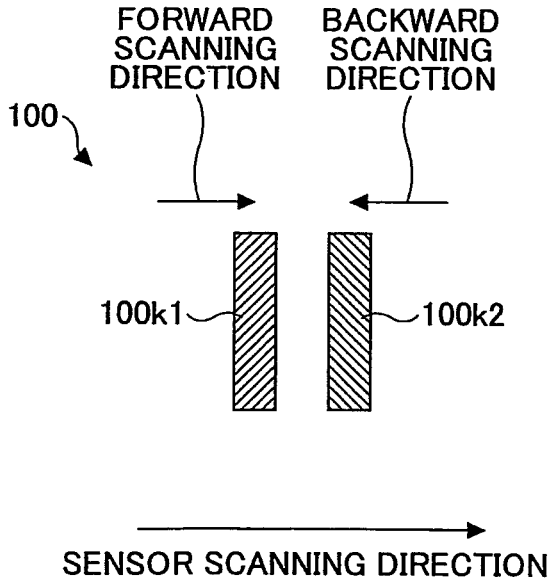
FIG. 23 is a configuration diagram illustrating a test pattern 100.

As illustrated in FIG. 20, in the recording apparatus according to the second embodiment, the test patterns 100 recorded on the recording medium 16 are read by a reading sensor 30, and a distance between a forward traveling mark **100*k*1 and a backward traveling mark 100*k*2 that form a test pattern 100 is computed for each test pattern 100 based on the test pattern 100 information read by the reading sensor 30 as illustrated in FIG. 23. Then, an ink ejecting time adjusting value at a position where the optimal test pattern 100 is recorded may be determined based on the distance between the forward traveling mark 100*k*1 and the backward traveling mark 100*k*2 computed for the corresponding test pattern 100. With this configuration, an optimal ink ejecting time adjusting value at a position where the optimal test pattern 100 is to be recorded may be automatically determined based on the test pattern 100 information read by the reading sensor 30**. A detailed description of the second embodiment is given below, with reference to the accompanying drawings.

[Configuration Examples of Recording Mechanism and Control Mechanism of Recording Apparatus]

Figure 21:
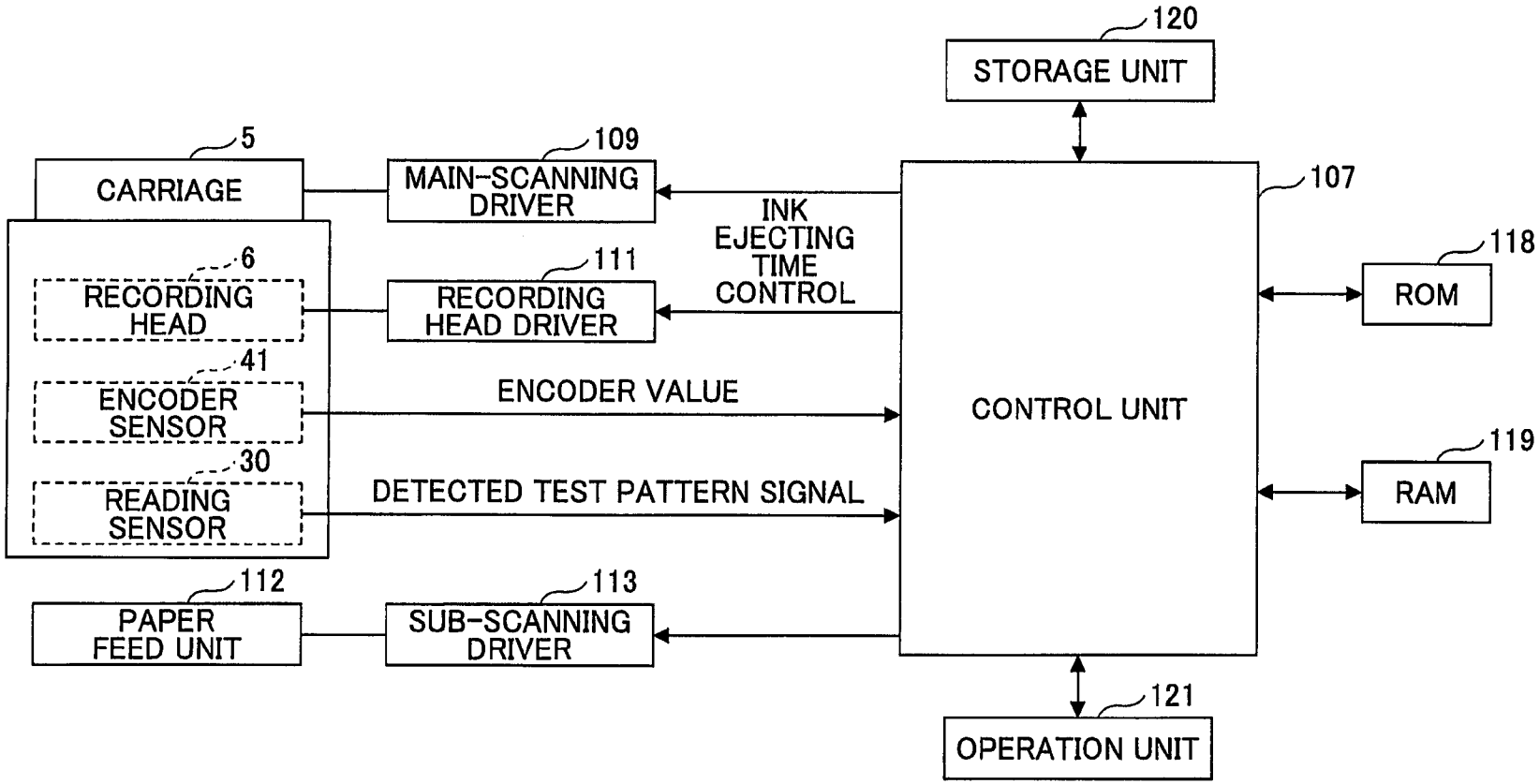
FIG. 21 is a schematic configuration diagram illustrating a control mechanism of the recording apparatus according to the second embodiment.

First, configuration examples of a recording mechanism and a control mechanism of the recording apparatus according to the second embodiment is described with reference to FIGS. 20 and 21. FIG. 20 illustrates the configuration example of the recording mechanism of the recording apparatus, and FIG. 21 illustrates the configuration example of the control mechanism of the recording apparatus according to the second embodiment.

In the recording apparatus according to the second embodiment, the carriage 5 includes the reading sensor 30. The reading sensor 30 is configured to read the test patterns 100. The reading sensor 30 emits light to the test pattern 100 and receives reflected light from the test pattern 100 to acquire a sensor output value of the test pattern 100.

Figure 22:
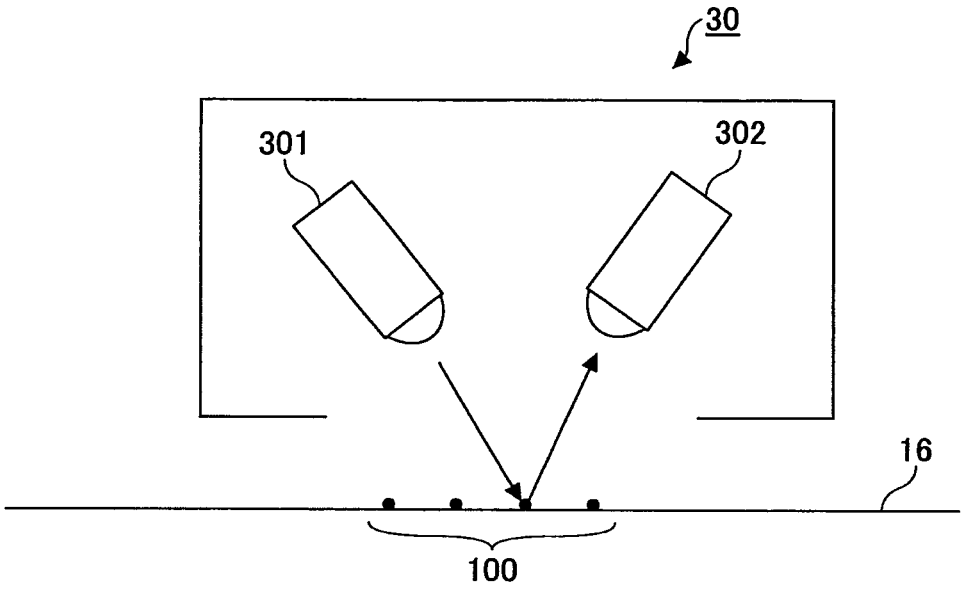
FIG. 22 is a configuration diagram illustrating a reading sensor 30 of the control mechanism.

The reading sensor 30 may be formed of a reflective optical sensor that includes a light-emitting unit 301 and a light-receiving unit 302 as illustrated in FIG. 22.

The light-emitting unit 301 emits light toward the test pattern 100 and the light emitted toward the test pattern 100 reflects off a surface of the test pattern 100.

The light-receiving unit 302 detects intensity of the reflected light reflected off the surface of the test pattern 100 and acquires the sensor output value of the reflected light received from the surface of the test pattern 100.

The reading sensor 30 outputs the acquired sensor output value of the test pattern 100 acquired by the light-receiving unit 302 to the control unit 107.

Note that the configuration of the reading sensor 30 and the method used by the reading sensor 30 to detect the reflected light from the test pattern 100 are not particularly limited insofar as the reading sensor 30 may detect the test pattern 100 recorded on the recording medium 16, and any configuration of the reading sensor 30 and any detecting method may be applied to the reading sensor 30. Similarly, the arrangement of the reading sensor 30 in the recording apparatus is not particularly limited insofar as the reading sensor 30 may detect the test pattern 100 recorded on the recording medium 16, and the reading sensor 30 may be arranged in any position of the recording apparatus. For example, the reading sensor 30 may be incorporated in the carriage 5, or may be separated from the carriage 5.

[Example of Test Pattern Recording Method]

Next, an example of a test pattern recording method is described with reference to FIG. 23.

As illustrated in FIG. 23, the test pattern 100 is formed by recording the forward traveling mark **100*k*1 and the backward traveling mark 100*k*2 in parallel without allowing the forward traveling mark 100*k*1 and the backward traveling mark 100*k*2 to overlap each other in the carriage traveling direction on the recording medium 16. Note that the backward traveling mark 100*k*2 is marked in an ink ejecting condition differing from that of the forward traveling mark 100*k*1. The test pattern 100 formed in this manner is then read by the reading sensor 30, and a distance between the forward traveling mark 100*k*1 and the backward traveling mark 100*k*2 that form the test pattern 100 is then computed. Note that a scanning direction in recording the forward traveling mark 100*k*1 (i.e., a forward scanning direction) and a scanning direction in moving the reading sensor 30 may be the same or different from each other. The test pattern 100 used in the second embodiment includes a combination of the forward traveling mark 100*k*1 and the backward traveling mark 100*k*2 as a minimum unit of the test pattern 100. FIG. 23 illustrates the test pattern 100 formed by recording the forward traveling mark 100*k*1 while the carriage 5 travels in the forward scanning direction and the backward traveling mark 100*k*2 while the carriage 5** travels in the backward scanning direction in parallel.

Figure 24A:
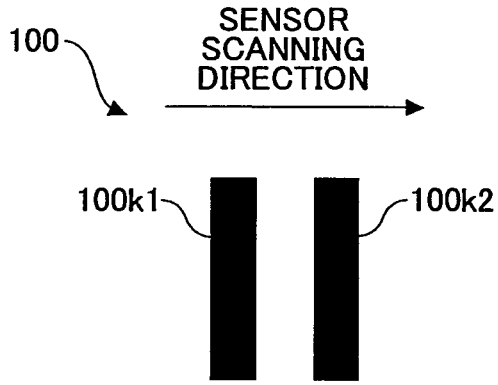
FIGS. 24A and 24B are diagrams illustrating a first position detecting process.
Figure 24B:
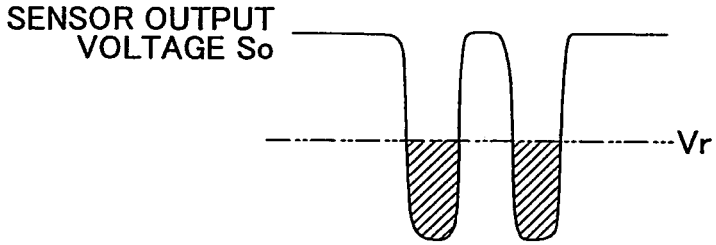
Figure 25A:
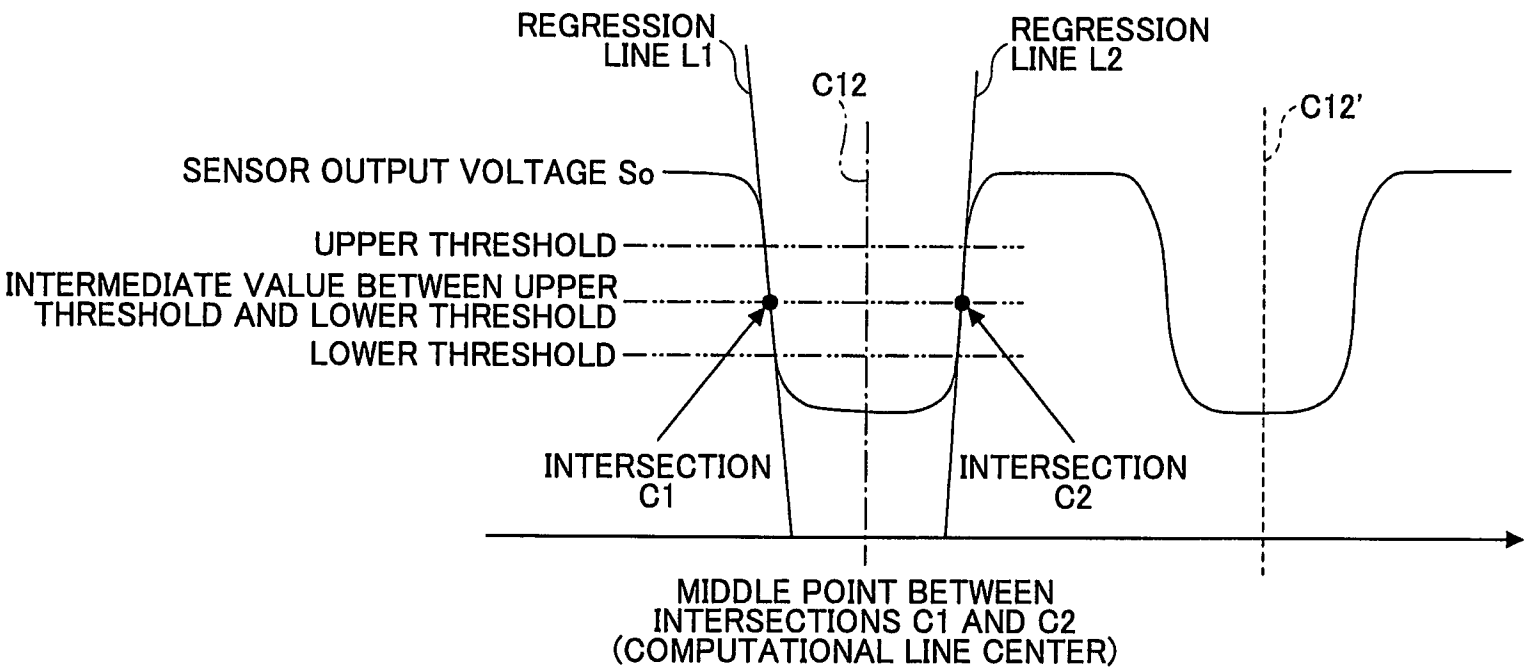
FIGS. 25A and 25B are diagrams illustrating a second position detecting process.
Figure 25B:
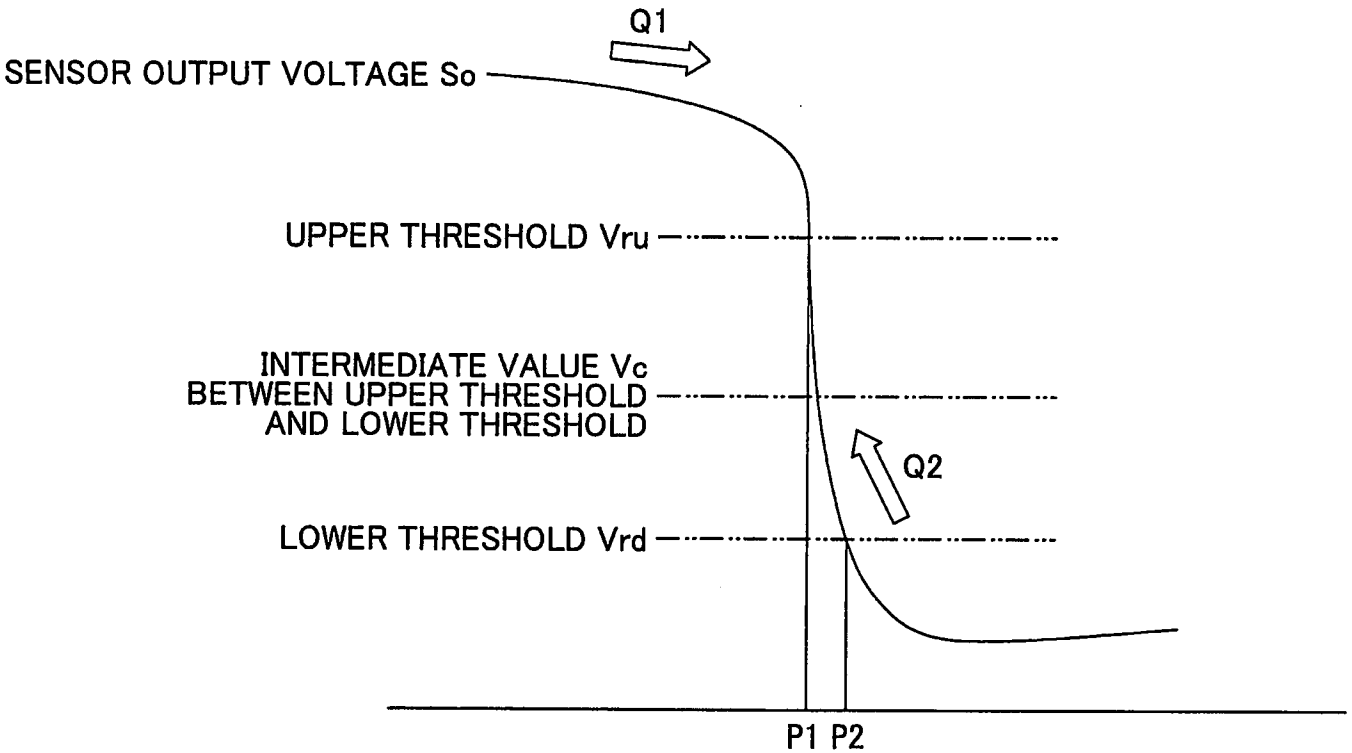
Figure 26:
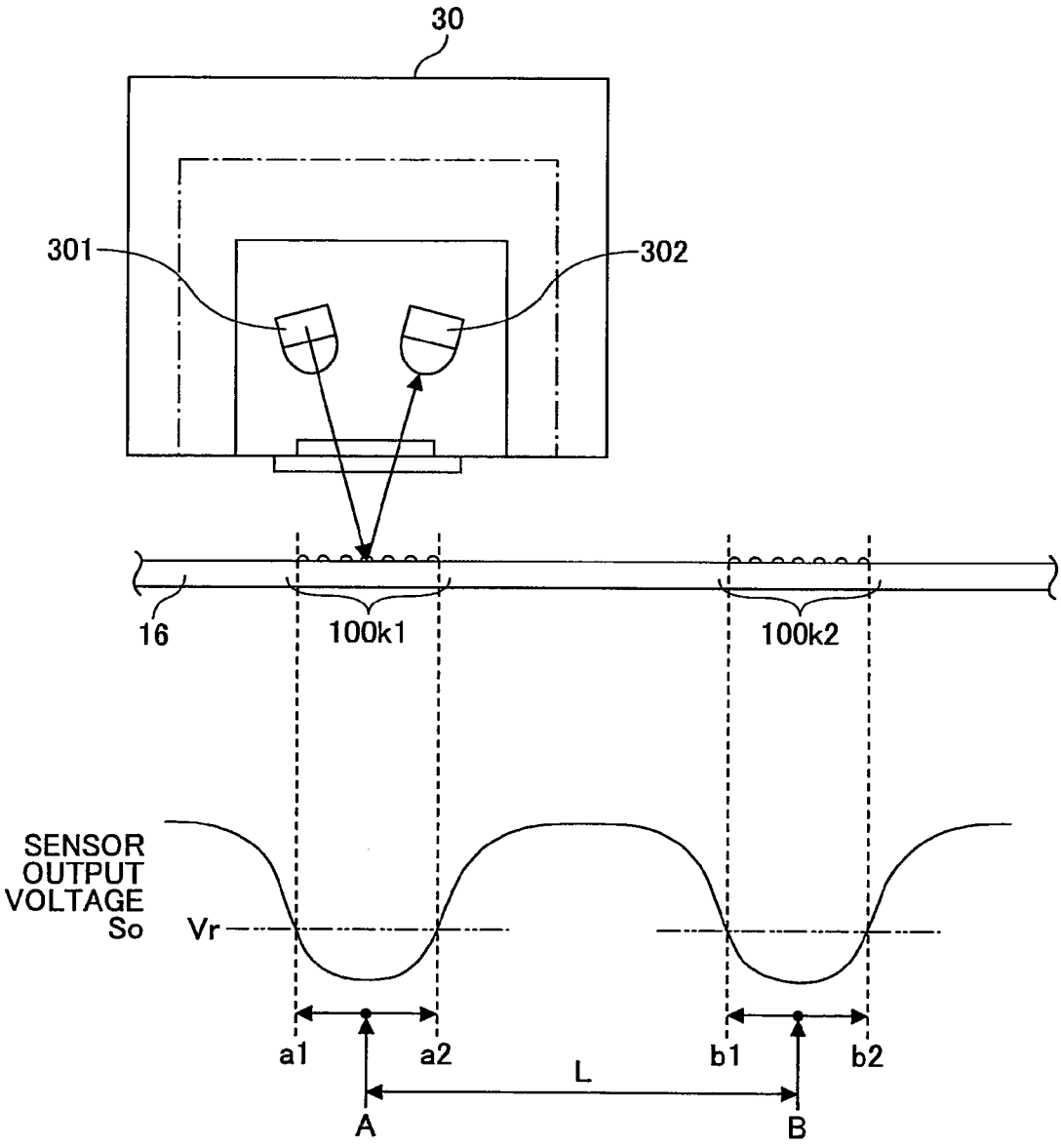
FIG. 26 is a diagram illustrating a third position detecting process.

Next, a position detecting process for detecting a position of the test pattern 100 formed on the recording medium 16 is described with reference to FIGS. 24A through 26. Note that in the following description, the test pattern 100 is formed of a combination of the forward traveling mark 100k1 and the backward traveling mark 100k2. The forward traveling mark 100k1 is formed by a recording head (i.e., first recording head) whereas the backward traveling mark 100k2 is formed by a different recording head (i.e., second recording head). The first and second recording heads are configured to eject black (Bk) ink. FIGS. 24A and 24B illustrate a first position detecting process example, FIGS. 25A and 25B illustrate a second position detecting process example, and FIG. 26 illustrates a third position detecting process example.

[First Position Detecting Process]

First, a first position detecting process is described with reference to FIGS. 24A and 24B.

Initially, a linear forward traveling mark 100k1 is recorded on the recording medium 16 by the first recording head and a linear backward traveling mark 100k2 is recorded on the recording medium 16 by the second recording head, thereby forming a test pattern 100 illustrated in FIG. 24A on the recording medium 16. Subsequently, the reading sensor 30 scans in the main scanning direction and acquires sensor output voltages So that fall at positions of the forward traveling mark 100k1 and the backward traveling mark 100k2 illustrated in FIG. 24B based on an output result of the light-receiving unit 302.

Next, the acquired sensor output voltages So are compared with a predetermined threshold Vr and any of the positions of the forward traveling mark 100k1 or the backward traveling mark 100k2 at which the acquired sensor output voltage So is lower than the predetermined threshold Vr is detected as the edge of the forward traveling mark 100k1 or the backward traveling mark 100k2, respectively. In this process, respective gravity centers of shaded regions in FIG. 24B enclosed by the threshold Vr and the sensor output voltage So are computed and the computed gravity centers are determined as respective central positions of the forward traveling mark 100k1 and the backward traveling mark 100k2. The central positions of the forward traveling mark 100k1 and the backward traveling mark 100k2 are detected in this manner.

[Second Position Detecting Process]

Next, a second position detecting process is described with reference to FIGS. 25A and 25B.

Initially, the test pattern 100 recorded on the recording medium 16 is read by the reading sensor 30 in the same manner as conducted in the first position detecting process, and the sensor output voltage So illustrated in FIG. 24A is acquired. FIG. 25B is an enlarged diagram of a falling portion of the sensor output voltage So illustrated in FIG. 25A.

Subsequently, in the falling portion of the sensor output voltage So, the reading sensor 30 searches for a point where the sensor output voltage So is lower than a lower threshold "Vrd" in a direction indicated by an arrow "Q1" in FIG. 25B and stores the found point as a point "P2". Next, the reading sensor 30 searches for a point where the sensor output voltage So is higher than an upper threshold "Vru" in a direction indicated by an arrow "Q2" from the point "P2", and stores the found point as a point "P1". Then, a regression line L1 is computed based on the sensor output voltages So between the point P1 and the point P2.

Subsequently, an intersection "C1" of the computed regression line L1 and an intermediate value "Vc" of the upper and lower thresholds is computed. Note that intermediate value Vc of the upper and lower thresholds indicates a middle value (i.e., median) between the upper threshold Vru and lower threshold Vrd.

Next, in the same manner as the falling portion of the sensor output voltage So, a regression line "L2" is computed in the rising portion of the sensor output voltage So, and an intersection "C2" of the computed regression line L2 and the intermediate value "Vc" of the upper and lower thresholds is computed.

Subsequently, a line center "C12" is computed by applying the intersections C1 and C2 to the following equation (1). The line center C12 indicates a middle point between the intersections C1 and C2.

$$\text{LINE CENTER } C12 = (\text{INTERSECTION } C1 + \text{INTERSECTION } C2)/2 \quad (1)$$

The line center C12 of the forward traveling mark 100k1 may be detected in this manner. Similarly, the line center C12' of the backward traveling mark 100k2 maybe detected in this manner. Thus, the central positions "C12" and "C12'" of the forward traveling mark 100k1 and the backward traveling mark 100k2 may be detected.

[Third Position Detecting Process]

Next, a third position detecting process is described with reference to FIG. 25A and 25B.

Initially, the test pattern 100 recorded on the recording medium 16 is read by the reading sensor 30 in the same manner as conducted in the first position detecting process, and the sensor output voltage (photoelectric converted output voltage) So illustrated in FIG. 26 is acquired.

Subsequently, harmonic noise is eliminated by an IIR filter (infinite impulse response filter), quality evaluation (e.g., defect, instability, and redundancy) is conducted on the detected signals, and slopes near the threshold Vr are detected. A regression curve is thus computed. Intersections a1, a2, b1, and b2 between the regression curve and threshold Vr are then computed, and an intermediate value A between the intersections a1 and a2 and an intermediate value B between the intersections b1 and b2 are also computed. The respective central positions A and B of the forward traveling mark 100k1 and the backward traveling mark 100k2 are detected in this manner.

In the recording apparatus according to the second embodiment, the respective central positions A and B of the forward traveling mark 100k1 and the backward traveling mark 100k2 may be detected by carrying out the first, second, or third position detecting process illustrated in FIGS. 24A to 26. Accordingly, a distance L between the central position A of the forward traveling mark 100k1 and the central position B of the backward traveling mark 100k2 may be computed. Further, the difference between the computed distance L and an ideal distance between the first and second recording heads and (obtained by "the ideal distance between the first and second recording heads and—L") may be computed. Thus, an optimal ink ejecting time adjusting value at a position where the test pattern 100 is recorded may be determined based on the computed difference between the distance L and the ideal distance between the first and second recording heads. Note that the ideal distance between the first and second recording heads may be stored in the storage unit 120 in advance. Hence, the optimal ink ejecting time adjusting value at a position where the test pattern 100 is recorded may be determined based on a result obtained by computing the difference between the distance L and the ideal distance between the first and second recording heads stored in the storage unit 120. In this manner, the control unit 107 determines the optimal ink ejecting time adjusting values for the positions P1 through P6 where the test patterns 100 are recorded in the main-scanning direction as illustrated in FIG. 4.

The control unit 107 linearly interpolates between the optimal ink ejecting time adjusting values and computes linearly interpolated ejecting time values for the respective intervals between adjacent points P1 through P6 based on the linear interpolation between the optimal ink ejecting time adjusting values.

The control unit 107 controls the ink ejecting time for the recording head 6 based on the linearly interpolated ejecting time values for the respective intervals between adjacent points P1 through P6 based on the linear interpolation between the optimal ink ejecting time adjusting values.

[Ejecting Time Adjusting Method]

Next, an ink ejecting time adjusting method according to the second embodiment is described with reference to FIG. 27.

Figure 27:
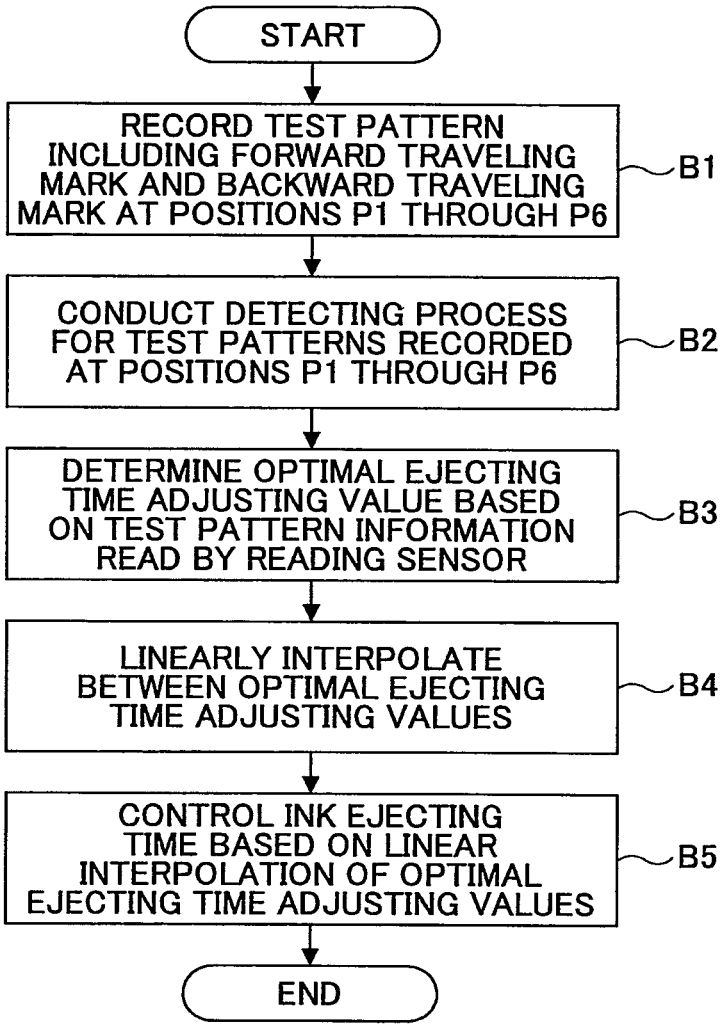
FIG. 27 is a flowchart illustrating an example of processing of the recording apparatus according to the second embodiment.

As illustrated in FIG. 27, first, the control unit 107 controls the driving of the carriage 5 such that the test patterns 100 are formed at the predetermined positions P1 through P6, the number of which corresponds to the number of the plate members 300 forming the platen 200, in the carriage traveling direction on the recording medium 16. Specifically, each test pattern 100 including a forward traveling mark **100*k*1 and a backward traveling mark 100*k*2 is formed by recording the forward traveling mark 100*k*1 while the carriage 5 is traveling in the forward traveling direction and recording the backward traveling mark 100*k*2 while the carriage 5 is traveling in the backward traveling direction; and the forward traveling mark 100*k*1 and the backward mark 100*k* are recorded in parallel without allowing the forward traveling mark 100*k*1 and the backward traveling mark 100*k*2 to overlap each other in the carriage traveling direction on the recording medium 16, thereby forming the test pattern 100 (step B1). Note that the control unit 107 records the test pattern 100 including the forward traveling mark 100*k*1 and the backward traveling mark 100*k*2 at the predetermined positions P1 through P6, the number of which corresponds to the number of the plate members 300 forming the platen 200**, in the carriage traveling direction.

Subsequently, the position detecting process is conducted for the test pattern 100 and the test pattern 100 is then read by the reading sensor 30. The distance L between the forward traveling mark **100*k*1 and the backward traveling mark 100*k*2 that form the test pattern 100 is computed for each of the test patterns 100 formed at the predetermined positions P1 through P6 (step B2**).

Subsequently, the difference between the computed distance L and the ideal distance between the first and second recording heads (obtained by "the ideal distance between the first and second recording heads—L") may be computed for each test pattern 100. An optimal ink ejecting time adjusting value at a position where the test pattern 100 is recorded is determined based on computed test pattern information including the computed difference between the distance L and the ideal distance between the first and second recording heads (step B3).

Next, the control unit 107 linearly interpolates between the optimal ink ejecting time adjusting values determined for the corresponding test patterns 100 and computes linearly interpolated ejecting times for the intervals between adjacent points P1 through P6 based on the linear interpolation between the optimal ink ejecting time adjusting values (step B4).

The control unit 107 controls the ink ejecting time for the recording head 6 based on the linearly interpolated ejecting time values for the corresponding intervals between adjacent points P1 through P6 based on the linear interpolation between the optimal ink ejecting time adjusting values (step B5).

[Interaction and Effect of Recording Apparatus]

As described above, in the recording apparatus according to the second embodiment, the control unit 107 controls the driving of the carriage 5 such that the test patterns 100 are recorded at the predetermined positions P1 through P6, the number of which correspond to the number of plate members 300 forming the platen 200, in the carriage traveling direction. Note that the test pattern 100 is composed of at least the forward traveling mark **100*k*1 recorded while the carriage 5 travels in the forward traveling direction and the backward traveling mark 100*k*2 recorded while the carriage 5 travels in the backward direction. Note that the forward traveling mark 100*k*1 and the backward traveling mark 100*k*2 are alternately arranged in parallel. Subsequently, the position detecting process is conducted for the test pattern 100 and the test pattern 100 is then read by the reading sensor 30. The distance L between the forward traveling mark 100*k*1 and the backward traveling mark 100*k*2 that form the test pattern 100 is computed for each of the test patterns 100 formed at the predetermined positions P1 through P6. Thereafter, an optimal ink ejecting time adjusting value at a position where the test pattern 100 is recorded is determined for each test pattern 100 based on the distance between the forward traveling mark 100*k*1 and the backward traveling mark 100*k*2 computed for the corresponding test pattern 100**.

Accordingly, the optimal test pattern 100 is automatically determined and an optimal ink ejecting time adjusting value at a position where the optimal test pattern 100 is recorded is determined for each test pattern based on the determined test pattern 100 information.

[Third Embodiment]

Next, a recording apparatus according to a third embodiment is described.

As illustrated in FIG. 4, in the recording apparatus according to the first and second embodiments, the test patterns 100 are recorded at the positions of the recording medium 16 corresponding to both end portions of the platen 200 and at the positions of the recording medium 16 corresponding to connecting portions of the plate members 300 connected in the main-scanning direction.

Figure 28:
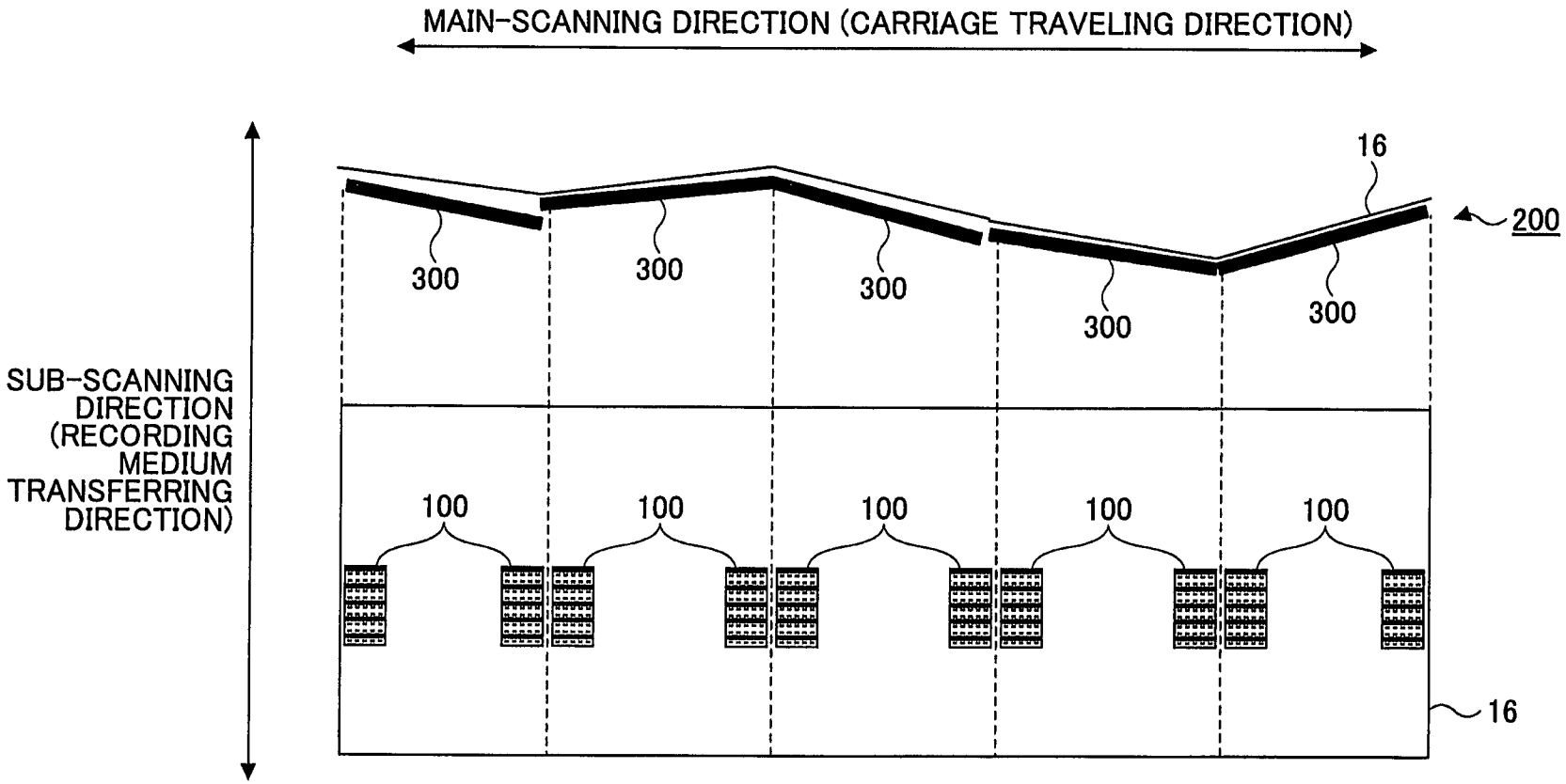
FIG. 28 is a configuration diagram illustrating a platen 200 composed of plate members 300 and test patterns 100 in a recording apparatus according to a third embodiment.

However, as illustrated in FIG. 28, in the recording apparatus according to the third embodiment, the test patterns 100 are recorded at the positions of the recording medium 16 corresponding to both end portions of the plate members 300 connected in the main-scanning direction to form the platen 200. In the third embodiment, if the number of plate members 300 forming the platen 200 is N, the number of test patterns 100 to be recorded on the recording medium 16 is obtained by N * 2. In FIG. 28, since five plate members 300 are connected to form the platen 200, the number of end portions of the connected plate members 300 is ten. Accordingly, there are a total number of 10 positions on the recording medium 16 at which the test patterns 100 are to be recorded. In the recording apparatus according to the third embodiment, since the ink ejecting times are adjusted in the same manner as those of the first and second embodiments using the test patterns illustrated in FIG. 28, it is possible to reduce the ink droplet misalignments occurring due to the changes in relative distances between the plural plate members 300 of the platen 200 and the carriage 5 in the main-scanning direction.

Fourth Embodiment]

Next, a recording apparatus according to a fourth embodiment is described.

Figure 29:
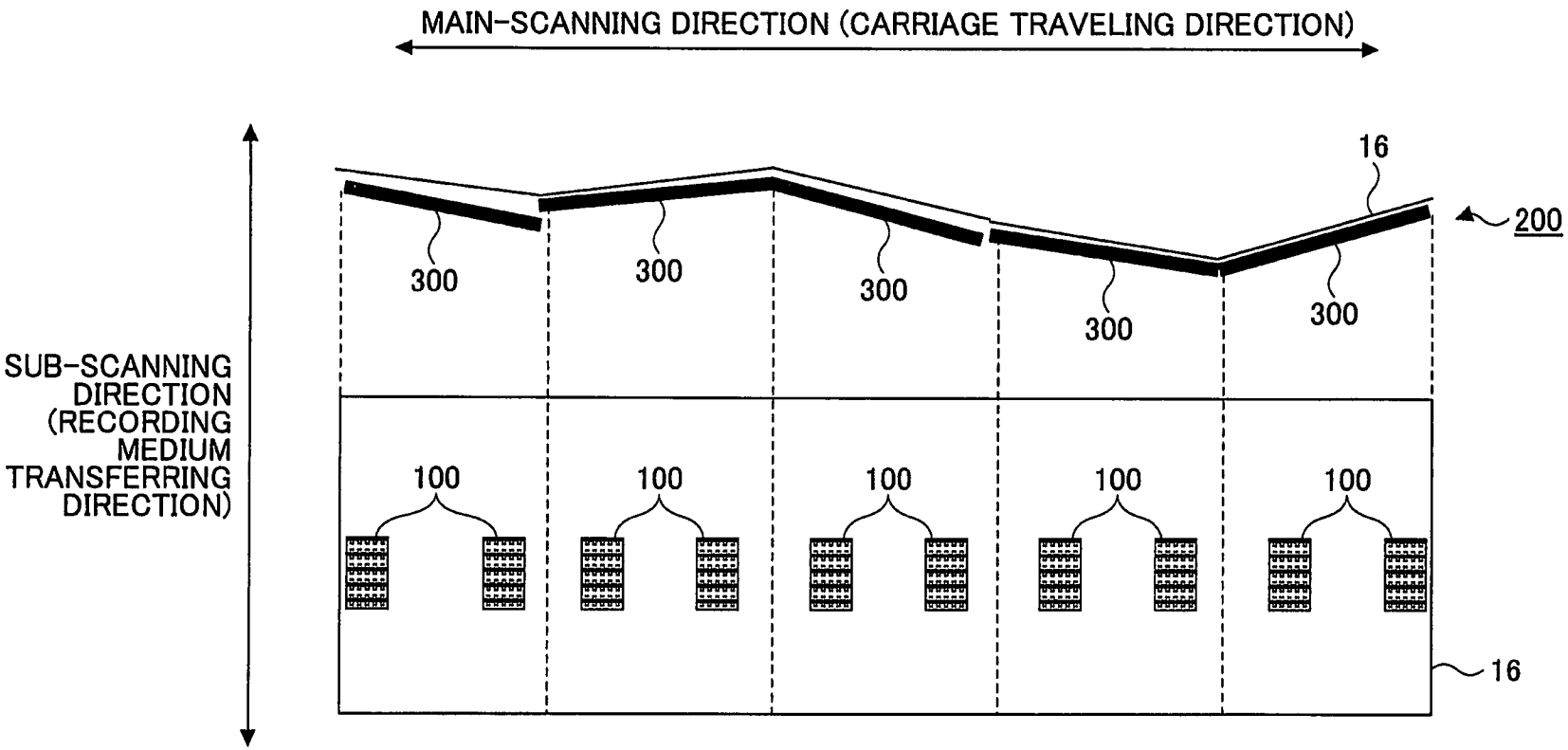
FIG. 29 is a configuration diagram illustrating a platen 200 composed of plate members 300 and test patterns 100 in a recording apparatus according to a fourth embodiment.

As illustrated in FIG. 29, in the recording apparatus according to the fourth embodiment, the test patterns 100 are recorded at any two positions of the recording medium 16 corresponding to each of the plate members 300 connected in the main-scanning direction to form the platen 200. In the fourth embodiment, if the number of plate members 300 forming the platen 200 is N, the number of test patterns 100 to be recorded on the recording medium 16 is obtained by N * 2. In FIG. 29, since five plate members 300 are connected to form the platen 200, the number of end portions of the connected plate members 300 is ten. Accordingly, there are a total number of 10 positions on the recording medium 16 at which the test patterns 100 are to be recorded.

Figure 30A:
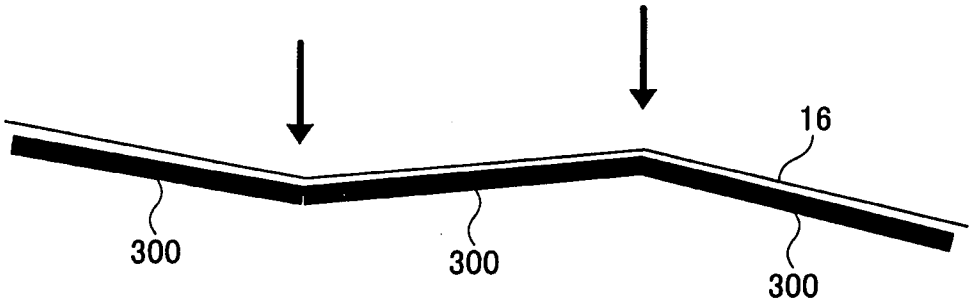
FIGS. 30A and 30B are configuration diagrams illustrating the platen 200 composed of the plate members 300 and recording media 16 in the recording apparatus according to the fourth embodiment.
Figure 30B:
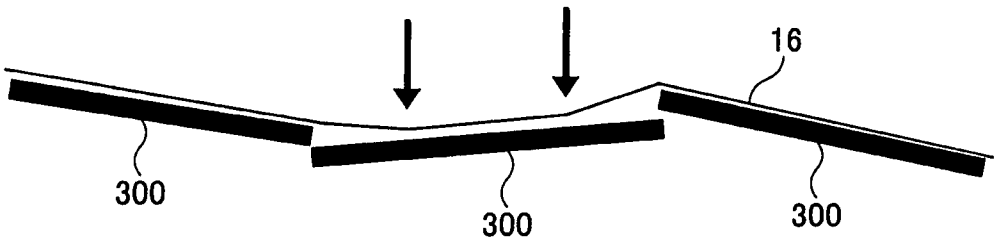

As illustrated in FIG. 30A, if the connecting portions of the platen 200 are continuous in a height direction of the platen 200, a slope of the recording medium 16 is changed at one position corresponding to one connecting portion of the plate member 300 indicated by arrows regardless of types of the recording medium 16. However, as illustrated in FIG. 30B, if the connecting portions of the platen 200 are discontinuous in a height direction of the platen 200, a slope of the recording medium 16 is changed at two positions corresponding to one connecting portion of the plate member 300 indicated by arrows.

Accordingly, as illustrated in FIG. 29, in the recording apparatus according to the fourth embodiment, the test patterns 100 are recorded at any two positions of the recording medium 16 corresponding to each of the plate members 300 connected in the main-scanning direction to form the platen 200, and linear interpolation between the ink ejecting time adjusting values obtained from the test patterns 100 is implemented. Thus, it is possible to reduce the ink droplet misalignments on the recording medium 16 when the relative distance between the platen 200 and the carriage 5 varies with the position of the carriage 5 in the main-scanning direction.

[Fifth Embodiment]

Next, a recording apparatus according to a fifth embodiment is described.

In the recording apparatus according to the fifth embodiment, any two positions of the recording medium 16 where the test patterns 100 are recorded based on the types of the recording medium 16 supported on the platen 200 are adjusted.

Figure 31A:
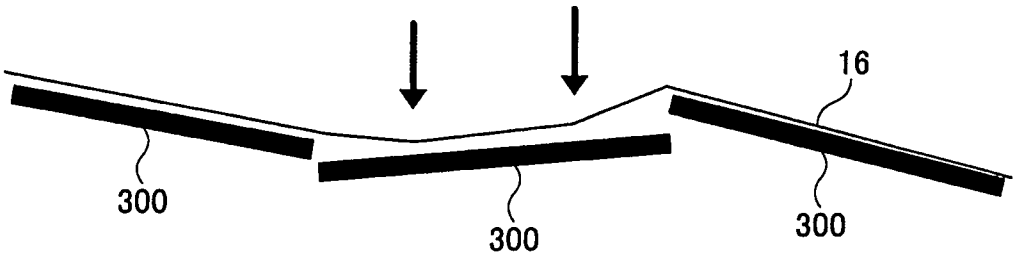
FIGS. 31A and 31B are configuration diagrams illustrating a platen 200 composed of plate members 300 and recording media 16 in a recording apparatus according to a fifth embodiment.
Figure 31B:
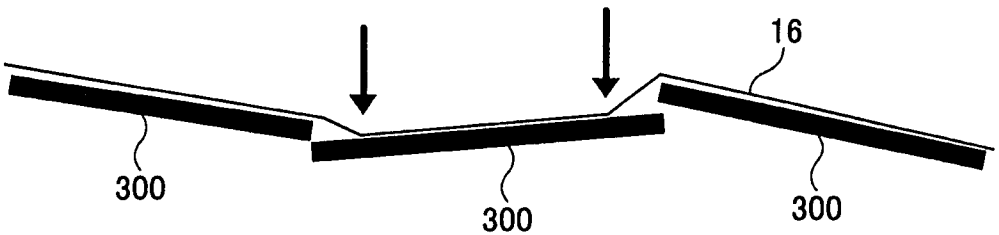

Similar to the fourth embodiment, if the connecting portions of the platen 200 are discontinuous in a height direction of the platen 200, a slope change position of the recording medium 16 is determined based on the rigidity of the recording medium 16. That is, if the recording medium 16 has a high rigidity, the slope change position of the recording medium 16 is located at a position having longer distance from the connecting portion of the plate members 300 as illustrated in FIG. 31A. If, on the other hand, the recording medium 16 has a low rigidity, the slope change position of the recording medium 16 is located at a position having shorter distance from the connecting portion of the plate members 300 as illustrated in FIG. 31B.

Accordingly, in the recording apparatus according to the fifth embodiment, the test patterns 100 are recorded at any two positions of the recording medium 16 that are adjusted based on the types of the recording medium 16, and linear interpolation between the ink ejecting time adjusting values obtained from the test patterns 100 is implemented. In this case, a correspondence table including the types of the recording medium 16 and the ink ejecting adjusting values based on the types of the recording medium 16 is managed in advance from which the ink ejecting time adjusting values corresponding to the types of the recording medium 16 are retrieved. Accordingly, any two positions on the recording medium 16 are adjusted based on the ink ejecting time adjusting values based on the types of the recording medium 16 retrieved from the correspondence table to thereby record the test patterns 100 on the corresponding recording medium 16. In this manner, the ink droplet misalignments may be reduced regardless of the types of the recording medium 16.

Note that the above-described embodiments indicate merely the preferred embodiments of the invention, which should not be construed as limiting the scope of the present invention. Various variations and modifications may be made without departing from the scope of the present invention.

For example, in the above embodiments, the control unit 107 is configured to execute a sequence of processing steps illustrated in FIGS. 10 and 27. However, the sequence of processing steps illustrated in FIGS. 10 and 27 may not be executed by the control unit 107 alone, but may be executed by plural control units.

Further, control operations of the components of the recording apparatus according to the embodiments may be achieved by hardware, software, or a combination of hardware and software.

If the control operations of the recording apparatus are achieved by the software, the control operations are achieved by executing computer programs composed of processing sequences that are installed in the memory incorporated in a computer of special-purpose hardware. Alternatively, the control operations are achieved by executing such computer programs installed in a general-purpose computer that is capable of various types of processing.

For example, the computer programs may be recorded in advance in hardware such as a recording medium or a Read-only memory (ROM). Alternatively, the computer programs may be recorded or stored temporarily or permanently in a removable recording medium. Such a removable recording medium may be provided as a software package. Note that examples of the removable recording medium include a floppy (Registered Trademark) disk, a compact disc read only memory (CD-ROM), a magneto-optical (MO) disk, a digital versatile disc (DVD), a magnetic disk, and a semiconductor memory.

Note that the above-described computer programs may be installed in the computer via such a removable recording medium. Alternatively, the above-described computer programs may be wirelessly transferred into the computer via a download site. Or, the above-described computer programs may be transferred by wire into the computer via the network.

Note also that the recording apparatus according to the embodiments may be configured such that the processing operations are not only carried out in time series but are also carried out individually or in parallel.

The recording apparatuses according to the above-described embodiments are suitable for inkjet printers.

The recording apparatus according to the above-described embodiments including the platen 200 composed of the plural plate members 300 connected in the main-scanning direction (carriage traveling direction) is capable of reducing the ink droplet misalignments occurring due to the changes in relative distances between the plural plate members forming the platen and the carriage 5 in the main-scanning direction.

Embodiments of the present invention have been described heretofore for the purpose of illustration. The present invention is not limited to these embodiments, but various variations and modifications may be made without departing from the scope of the present invention. The present invention should not be interpreted as being limited to the embodiments that are described in the specification and illustrated in the drawings.

The present application is based on Japanese Priority Application No. 2010-130243 filed on Jun. 7, 2010, with the Japanese Patent Office, the entire contents of which are hereby incorporated by reference.

What is claimed is:

1. A recording apparatus comprising:

a carriage having a recording head including plural nozzles for ejecting ink;

a moving unit configured to move the carriage having the recording head including the plural nozzles for ejecting ink;

a platen including plate members connected in a carriage traveling direction and configured to support a recording medium when the plural nozzles of the carriage eject ink onto the recording medium;

a transferring unit configured to transfer the recording medium in a transferring direction perpendicular to the carriage traveling direction;

a recording control unit configured to record patterns at predetermined positions, a number of which corresponds to a number of plate members, in the carriage traveling direction on a surface of the recording medium supported by the platen while moving the carriage in forward and backward traveling directions to form a carriage traveling direction pattern array;

a determination unit configured to determine ink ejecting times at the predetermined positions in the carriage traveling direction where the respective patterns are recorded on the surface of the recording medium; and a time control unit configured to linearly interpolate between the determined ink ejecting times at the predetermined positions in the carriage traveling direction on the surface of the recording medium to control ink ejecting times for respective intervals between the predetermined positions in the carriage traveling direction based on the linear interpolation between the determined ink ejecting times at the predetermined positions in the carriage traveling direction.

2. The recording apparatus as claimed in claim 1, wherein the recording control unit forms a plurality of the carriage traveling direction pattern arrays in the transferring direction by relatively differentiating recording times to record the patterns in the forward traveling direction at the predetermined positions from recording times to record the patterns in the backward traveling direction at the predetermined positions such that a pattern group including the plurality of the carriage traveling direction pattern arrays and a plurality of transferring direction pattern arrays is formed on the recording medium, and a determination unit determines the ink ejecting time at each of the predetermined positions in the carriage traveling direction by selecting an optimal pattern from a corresponding one of the transferring direction pattern arrays in the pattern group.

3. The recording apparatus as claimed in claim 1, further comprising:

a reading unit configured to read the patterns formed at the predetermined positions in the carriage traveling direction on the surface of the recording medium, wherein the recording control unit alternately arranges a forward traveling mark that is recorded while the carriage travels in a forward traveling direction and a backward traveling mark that is recorded while the carriage travels in a backward traveling direction to form each of the patterns at the predetermined positions in the carriage traveling direction on the surface of the recording medium, and wherein the determination unit computes a distance between the forward traveling mark and the backward traveling mark of each of the patterns at the predetermined positions in the carriage traveling direction based on a signal of the pattern read by the reading unit, and determines an ink ejecting time at each of the predetermined positions in the carriage traveling direction based on the computed distance between the forward traveling mark and the backward traveling mark of the corresponding patterns at the predetermined positions in the carriage traveling direction.

4. The recording apparatus as claimed in claim 1, wherein the time control unit manages the ink ejecting times determined at the predetermined positions associated with the respective predetermined positions, and linearly interpolates between a first ink ejecting time associated with a first position and a second ink ejecting time associated with a second position to control the ink ejecting time for an interval between the first position and the second position based on a linearly interpolated ink ejecting time obtained by the linear interpolation between the first ink ejecting time and the second ink ejecting time.

5. The recording apparatus as claimed in claim 1, wherein the predetermined positions include end portions of the platen and connecting portions of the plate members that form the platen.

6. The recording apparatus as claimed in claim 1, wherein the predetermined positions include end portions of each of the plate members that form the platen.

7. The recording apparatus as claimed in claim 1, wherein the predetermined positions include any two positions of each of the plate members that form the platen.

8. The recording apparatus as claimed in claim 7, wherein the recording control unit adjusts the two positions of the each of the plate members that form the platen based on types of the recording medium supported by the platen.

9. A method for controlling a recording apparatus including a carriage having a recording head including plural nozzles for ejecting ink, a moving unit configured to move the carriage, a platen including plate members connected in a carriage traveling direction and configured to support a recording medium when the plural nozzles of the carriage eject ink onto the recording medium, and a transferring unit configured to transfer the recording medium in a direction perpendicular to the carriage traveling direction, the method comprising:

recording patterns at predetermined positions, a number of which corresponds to a number of plate members, in the carriage traveling direction on a surface of the recording medium supported by the platen while moving the carriage in forward and backward traveling directions to form a carriage traveling direction pattern array;

determining ink ejecting times at the predetermined positions in the carriage traveling direction where the respective patterns are recorded on the surface of the recording medium; and linearly interpolating between the determined ink ejecting times at the predetermined positions in the carriage traveling direction on the surface of the recording medium to control ink ejecting times for respective intervals between the predetermined positions in the carriage traveling direction based on the linear interpolation between the determined ink ejecting times at the predetermined positions in the carriage traveling direction.

* * * * *